US010947077B2

(12) United States Patent
Taki

(10) Patent No.: US 10,947,077 B2
(45) Date of Patent: Mar. 16, 2021

(54) SHEET POST-PROCESSING APPARATUS AND METHOD FOR CONTROLLING THE SHEET POST-PROCESSING APPARATUS

(71) Applicants: KABUSHIKI KAISHA TOSHIBA, Tokyo (JP); TOSHIBA TEC KABUSHIKI KAISHA, Tokyo (JP)

(72) Inventor: Hiroyuki Taki, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 182 days.

(21) Appl. No.: 16/192,211

(22) Filed: Nov. 15, 2018

(65) Prior Publication Data

US 2019/0084787 A1 Mar. 21, 2019

Related U.S. Application Data

(63) Continuation of application No. 15/385,852, filed on Dec. 20, 2016, now Pat. No. 10,150,643.

(30) Foreign Application Priority Data

Apr. 28, 2016 (JP) ..... 2016-092039

(51) Int. Cl.
*B65H 37/04* (2006.01)
*B65H 31/02* (2006.01)
(Continued)

(52) U.S. Cl.
CPC ..... *B65H 37/04* (2013.01); *B65H 29/125* (2013.01); *B65H 31/02* (2013.01);
(Continued)

(58) Field of Classification Search
CPC ..... B65H 37/04; B65H 43/06; B65H 29/125; B65H 31/34; B65H 31/02; B65H 31/3018;
(Continued)

(56) References Cited

U.S. PATENT DOCUMENTS 5,384,634 A 1/1995 Takehara et al.
6,219,503 B1 4/2001 Miyake et al.
(Continued)

FOREIGN PATENT DOCUMENTS

CN 104418151 A 3/2015
CN 104743396 A 7/2015
(Continued)

OTHER PUBLICATIONS

Japanese Office Action dated Feb. 28, 2020, mailed in counterpart Japanese Application No. 2016-092039, 8 pages (with translation).
(Continued)

*Primary Examiner* — Patrick H Mackey
(74) *Attorney, Agent, or Firm* — Kim & Stewart LLP

(57) ABSTRACT

According to embodiments, a sheet post-processing apparatus includes a processing tray, a vertical alignment section, a horizontal alignment section and a controller. The controller is configured to control the horizontal alignment section to shift the sheet to a first alignment position a predetermined distance from the center of the processing tray in the sheet width direction, control the horizontal alignment section to align the sheet in the sheet width direction at the first alignment position, and control the vertical alignment section to align the sheet in the conveying direction at the first alignment position, control the horizontal alignment section to realign the sheet at the first alignment position.

11 Claims, 24 Drawing Sheets

(51) Int. Cl.

| | |
|---|---|
| ***B65H 31/30*** | (2006.01) |
| ***B65H 31/36*** | (2006.01) |
| ***B65H 31/38*** | (2006.01) |
| ***B65H 43/06*** | (2006.01) |
| ***B65H 29/12*** | (2006.01) |
| ***B65H 31/34*** | (2006.01) |

(52) U.S. Cl.
CPC ..... *B65H 31/3018* (2013.01); *B65H 31/34* (2013.01); *B65H 31/36* (2013.01); *B65H 31/38* (2013.01); *B65H 43/06* (2013.01); *B65H 2301/163* (2013.01); *B65H 2301/4212* (2013.01); *B65H 2301/4213* (2013.01); *B65H 2404/1114* (2013.01); *B65H 2511/30* (2013.01); *B65H 2801/24* (2013.01); *B65H 2801/27* (2013.01)

(58) Field of Classification Search
CPC .... B65H 31/36; B65H 31/38; B65H 2511/30; B65H 2220/01
See application file for complete search history.

(56) References Cited

U.S. PATENT DOCUMENTS

| | | | | |
|---|---|---|---|---|
| 6,220,592 | B1 | 4/2001 | Watanabe et al. | |
| 6,561,503 | B1 * | 5/2003 | Ogata | B65H 9/106 270/58.08 |
| 7,043,192 | B2 | 5/2006 | Terao et al. | |
| 7,215,922 | B2 | 5/2007 | Terao et al. | |
| 7,286,792 | B2 | 10/2007 | Terao et al. | |
| 7,665,730 | B2 * | 2/2010 | Funada | B65H 9/106 271/250 |
| 7,747,212 | B2 | 6/2010 | Yamamoto | |
| 7,862,025 | B2 | 1/2011 | Sugizaki | |
| 7,954,801 | B2 * | 6/2011 | Fukami | B65H 37/04 270/58.11 |
| 7,997,577 | B2 | 8/2011 | Oshiro et al. | |
| 8,672,313 | B2 * | 3/2014 | Fukami | B42C 1/125 270/58.09 |
| 9,415,966 | B2 | 8/2016 | Nishi et al. | |
| 9,827,801 | B2 | 11/2017 | Taguchi et al. | |
| 2007/0126167 | A1 | 6/2007 | Kushida | |
| 2007/0145660 | A1 | 6/2007 | Terao et al. | |
| 2008/0315492 | A1 | 12/2008 | Taki et al. | |
| 2009/0014941 | A1 | 1/2009 | Taki et al. | |
| 2010/0289205 | A1 | 11/2010 | Taki | |
| 2011/0115152 | A1 | 5/2011 | Sugizaki | |
| 2012/0025442 | A1 | 2/2012 | Naraoka | |
| 2015/0023765 | A1 | 1/2015 | Hongu | |
| 2015/0183606 | A1 | 7/2015 | Nishi et al. | |
| 2015/0225200 | A1 | 8/2015 | Yamashita et al. | |

FOREIGN PATENT DOCUMENTS

| | | | |
|---|---|---|---|
| JP | S6417765 | A | 1/1989 |
| JP | 2000219418 | A | 8/2000 |
| JP | 2008189470 | A | 8/2008 |
| JP | 2008214102 | A | 9/2008 |
| JP | 2012096869 | A | 5/2012 |
| JP | 2013095533 | A | 5/2013 |
| JP | 2013160797 | A | 8/2013 |
| JP | 2015124069 | A | 7/2015 |

OTHER PUBLICATIONS

Extended European Search Report dated Sep. 26, 2017, mailed in counterpart European Application No. 17160236.0, 11 pages.

* cited by examiner

SHEET POST-PROCESSING APPARATUS AND METHOD FOR CONTROLLING THE SHEET POST-PROCESSING APPARATUS

CROSS-REFERENCE TO RELATED APPLICATIONS

This application is a continuation of U.S. patent application Ser. No. 15/385,852, filed on Dec. 20, 2016, which claims priority from Japanese Patent Application No. 2016-092039, filed on Apr. 28, 2016, the entire contents of each of which are incorporated herein by reference.

FIELD

Embodiments described herein generally relate to a sheet post-processing apparatus.

BACKGROUND

A sheet post-processing apparatus is known which executes a post-processing such as a stapling processing on sheets loaded on a processing tray. In order to adjust deviation between the sheets loaded on the processing tray which are subjected to the post-processing, the sheet post-processing apparatus includes a horizontal aligning member and a vertically aligning member. The horizontal aligning member is a member for aligning a deviation in the width direction of the sheet. The vertical aligning member is a member for aligning a deviation in a direction orthogonal to the width direction of the sheet.

The above vertical aligning member is fixed against the sheet post-processing apparatus. Thus, the aligning processing by vertical aligning member might cause the deviation of sheets to arise, depending on the position of sheet aligning.

DETAILED DESCRIPTION

According to an embodiment, a sheet post processing apparatus includes a processing tray, a vertical alignment section, a horizontal alignment section and a controller. The processing tray loads a sheet. The vertical alignment section that is attached to a rotational shaft, aligns the sheet on the processing tray in a sheet conveying direction by rotating around the rotational shaft. The horizontal alignment section is configured to align the sheet in a sheet width direction orthogonal to the sheet conveying direction, by sandwiching with a first alignment member and a second alignment member. The controller controls the horizontal alignment section to shift the sheet to a first alignment position a predetermined distance from the center of the processing tray in the sheet width direction, controls the horizontal alignment section to align the sheet in the sheet width direction at the first alignment position, and controls the vertical alignment section to align the sheet in the conveying direction at the first alignment position, controls the horizontal alignment section to realign the sheet at the first alignment position.

Hereinafter, the sheet post-processing apparatus of the embodiment is described with reference to the accompanying drawings. Furthermore, in the following description, the same numerals are applied to configurations having identical or similar functions. Further, there is a case in which the repeated description of these configurations is omitted.

Figure 1:
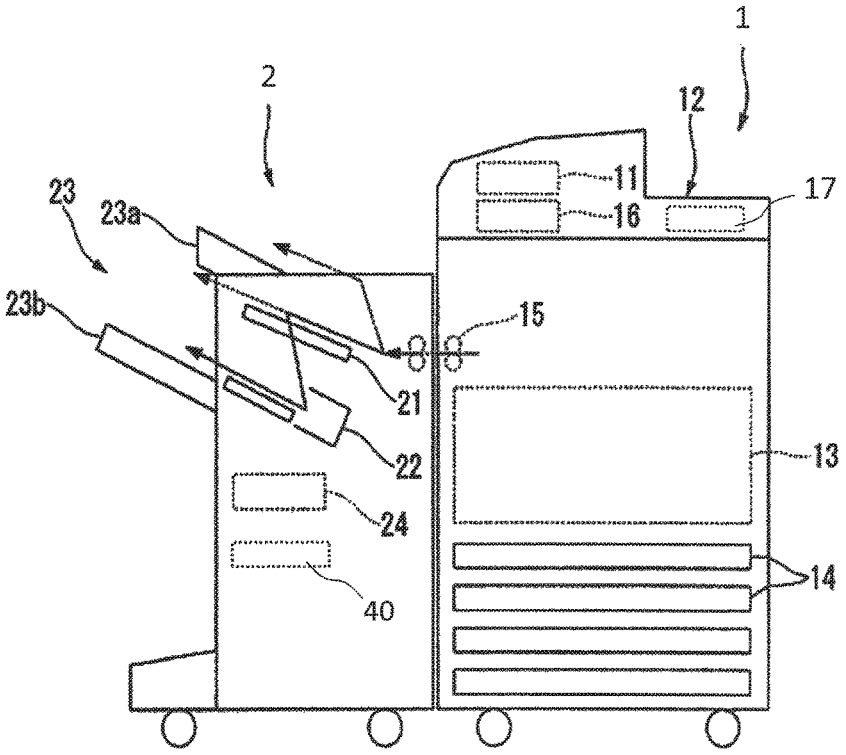
FIG. 1 is a diagram illustrating an image forming system according to an embodiment.
Figure 2:
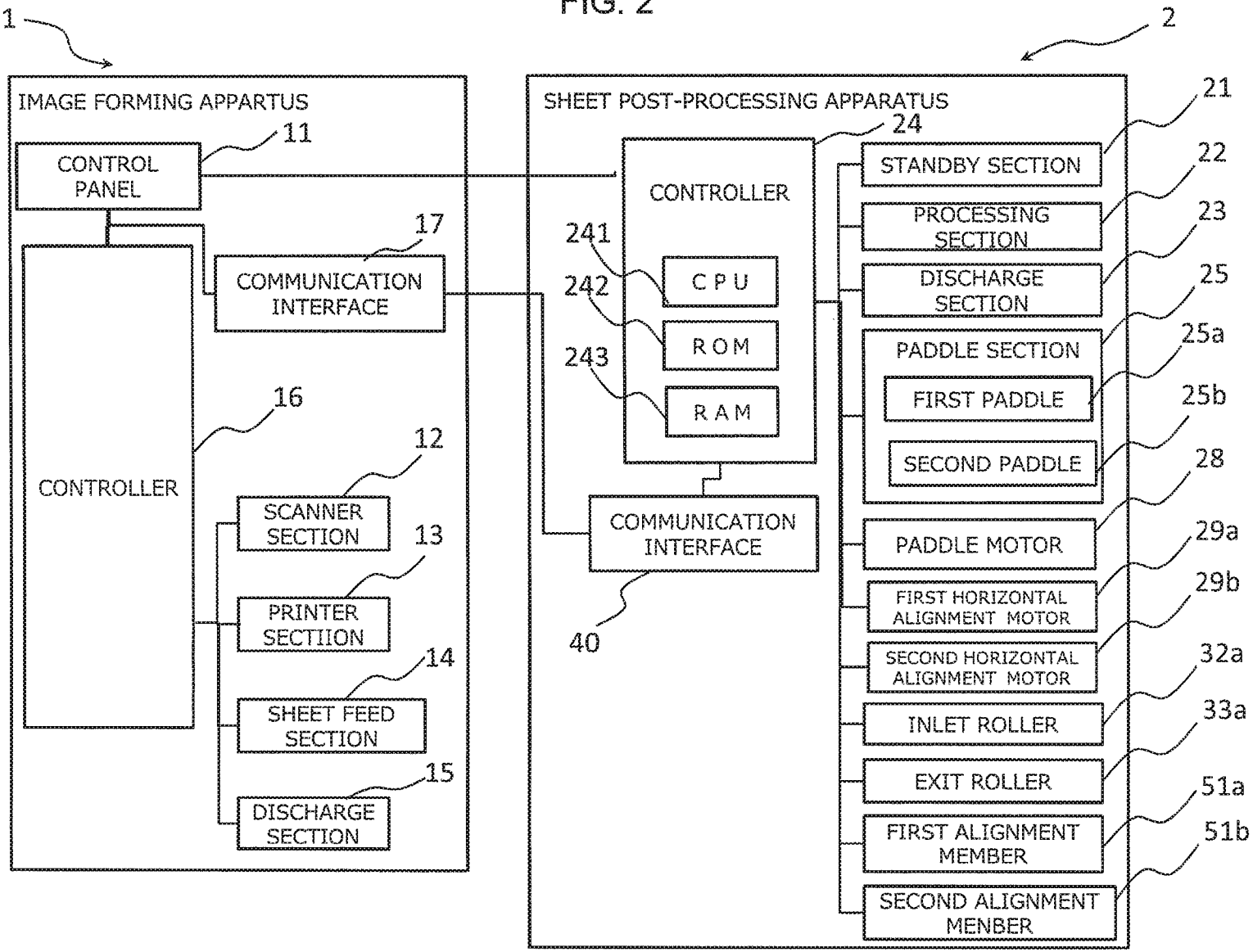
FIG. 2 is an electrical block diagram illustrating an image forming apparatus and a sheet post-processing apparatus.

FIG. 1 is a diagram illustrating the entire configuration of an image forming system. FIG. 2 is an electrical block diagram illustrating an image forming apparatus and a sheet post-processing apparatus. The image forming system includes an image forming apparatus 1 and a sheet post-processing apparatus 2. The image forming apparatus 1 forms an image on a sheet-like medium (hereinafter, referred to as a "sheet") such as a paper. The sheet post-processing apparatus 2 carries out a post processing on a sheet conveyed from the image forming apparatus 1.

The image forming apparatus 1 includes a control panel 11, a scanner section 12, a printer section 13, a sheet feed section 14, a sheet discharge section 15, an controller 16 and a communication interface 17.

The control panel 11 has interface including various keys for receiving operations of a user. For example, the control panel 11 receives an input relating to a type of the post processing of the sheet. The control panel 11 sends information relating to the input type of the post processing to the sheet post-processing apparatus 2.

The scanner section 12 includes a reading section for reading image information of a scanning target. The scanner section 12 sends the read image information to the printer section 13.

The printer section 13 forms an image (hereinafter, referred to as a "toner image") with a developing agent such as toner on the basis of the image information sent from the scanner section 12 or an external device such as a client PC. The printer section 13 transfers the toner image onto a surface of the sheet. The printer section 13 fixes the toner image by applying heat and pressure to the toner image transferred onto the sheet.

The sheet feed section 14 supplies the sheets one by one to the printer section 13. The sheet discharge section 15 conveys the sheet from the printer section 13 to the sheet post-processing apparatus 2.

As shown in FIG. 2, the controller 16 controls all operations of the image forming apparatus 1. In other words, the controller 16 controls the control panel 11, the scanner section 12, the printer section 13, the sheet feed section 14 and the sheet discharge section 15. The controller 16 is formed by a control circuit including a CPU, a ROM and a RAM that are not shown. Further, the communication interface 17 sends the information relating to a printing job that is send from the control panel 11 and the external device to the sheet post-processing apparatus 2.

Next, the configuration of the sheet post-processing apparatus 2 is described with reference to FIG. 1 and FIG. 2. As shown in FIG. 1, the sheet post-processing apparatus 2 is arranged adjacent to the image forming apparatus 1. The sheet post-processing apparatus 2 executes a post processing on the sheet conveyed from the image forming apparatus 1. The post processing executed by the sheet post-processing apparatus 2 is designated through the control panel 11 or the external device such as a client PC. For example, the post processing includes a stapling processing or a sorting processing.

The sheet post-processing apparatus 2 includes a standby section 21, a processing section 22, a discharge section 23, a controller 24 and a communication interface 40. The standby section 21 temporarily buffers a sheet S (refer to FIG. 3) conveyed from the image forming apparatus 1. For example, the standby section 21 enables a plurality of following sheets S to stand by while the post processing on the preceding sheets is carried out by the processing section 22. The standby section 21 is arranged above the processing section 22. The standby section 21 enables the buffered plurality of sheets to drop towards the processing section 22 if the sheet in the processing section 22 is discharged to the discharge section 23.

The processing section 22 carries out the post processing on the sheet S. For example, the processing section 22 carries out the stapling processing on a plurality of the aligned sheets S. In this way, a plurality of the sheets is bound together by the staple. The processing section 22 discharges the sheet S on which the post processing is carried out to the discharge section 23.

The discharge section 23 includes a fixed tray 23*a* and a movable tray 23*b*. The fixed tray 23*a* is arranged on the upper part of the sheet post-processing apparatus 2. The movable tray 23*b* is arranged on the side of the sheet post-processing apparatus 2. The sheet S to which the stapling processing or the sorting processing is carried out is discharged to the movable tray 23*b*. The movable tray 23*b* receives the sheet S which is stapled or sorted.

As shown in FIG. 2, the controller 24 controls all operations of the sheet post-processing apparatus 2. The controller 24 controls the standby section 21, the processing section 22 and the discharge section 23. Further, the controller 24 controls an inlet roller 32*a*, an exit roller 33*a*, a paddle section 25, a paddle motor 28, a first horizontal alignment motor 29*a*, a second horizontal alignment motor 29*b*, a first alignment member 51*a* and a second alignment member 51*b*. The controller 24 includes a control circuit containing a CPU 241, a ROM 242 and a RAM 243. The first horizontal alignment member 51*a* and the second horizontal alignment 51*b* may be configured to be movable by one motor. The communication interface 40 receives the information such as a printing job sent from the image forming apparatus 2. Further the communication interface 40 sends an error information regarding occurring in the sheet post-processing apparatus 2.

Figure 3:
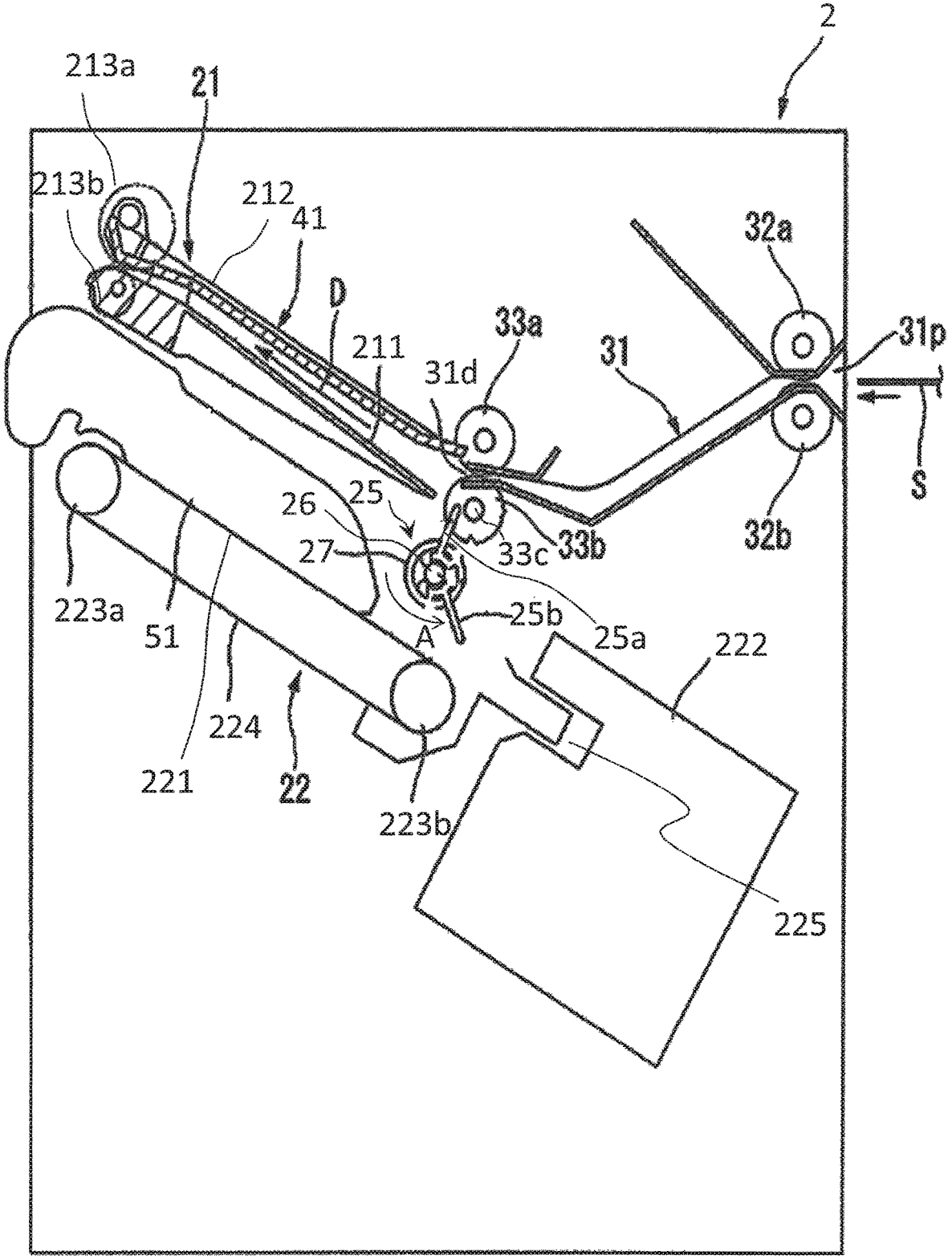
FIG. 3 is a diagram illustrating details of the configuration of each section of the sheet post-processing apparatus.

FIG. 3 illustrates a configuration of the sheet post-processing apparatus 2. Furthermore, a "sheet conveyance direction" described in the present embodiment refers to a conveyance direction D of the sheet S to the standby tray 211 of the standby section 21 (an approach direction of the sheet S to the standby tray 211) or a direction in which the sheet S is conveyed from the processing tray 221 to the movable tray 23*b*. Further, an "upstream side" and a "downstream side" described in the present embodiment respectively refer to the upstream side and the downstream side in the sheet conveyance direction D. Further, a "front end part" and a "back end part" described in the present embodiment respectively refer to "the end part of the downstream side" and "the end part of the upstream side" in the sheet conveyance direction D. In the present embodiment, a direction orthogonal to the sheet conveyance direction D is referred to as a sheet width direction W.

A conveyance path 31 is a conveyance path from a sheet supply port 31*p* to a sheet discharge port 31*d*. The sheet supply port 31*p* is arranged at a position facing the image forming apparatus 1. The sheet S is supplied from the image forming apparatus 1 to the sheet supply port 31*p*. On the other hand, the sheet discharge port 31*d* is located in the vicinity of the standby section 21. The sheet S discharged from the image forming apparatus 1 is discharged to the standby section 21 via the conveyance path 31.

The inlet rollers 32*a* and 32*b* are arranged in the vicinity of the sheet supply port 31*p*. The inlet rollers 32*a* and 32*b* convey the sheet S supplied to the sheet supply port 31*p* to the exit rollers 33*a* and 33*b*.

The exit rollers 33*a* and 33*b* are arranged in the vicinity of the sheet discharge port 31*d*. The exit rollers 33*a* and 33*b* receive the sheet S conveyed by the inlet rollers 32*a* and 32*b*. The exit rollers 33*a* and 33*b* convey the sheet S from the sheet discharge port 31*d* to the standby section 21.

The standby section 21 includes the standby tray (buffer tray) 211, a conveyance guide 212, discharge rollers 213*a* and 213*b* and an opening and closing driving section (not shown).

The back end part of the standby tray 211 is located in the vicinity of the exit rollers 33*a* and 33*b*. The standby tray 211 stacks a plurality of the sheets S to enable them to stand by while the post processing is carried out by the processing section 22.

Figure 4:
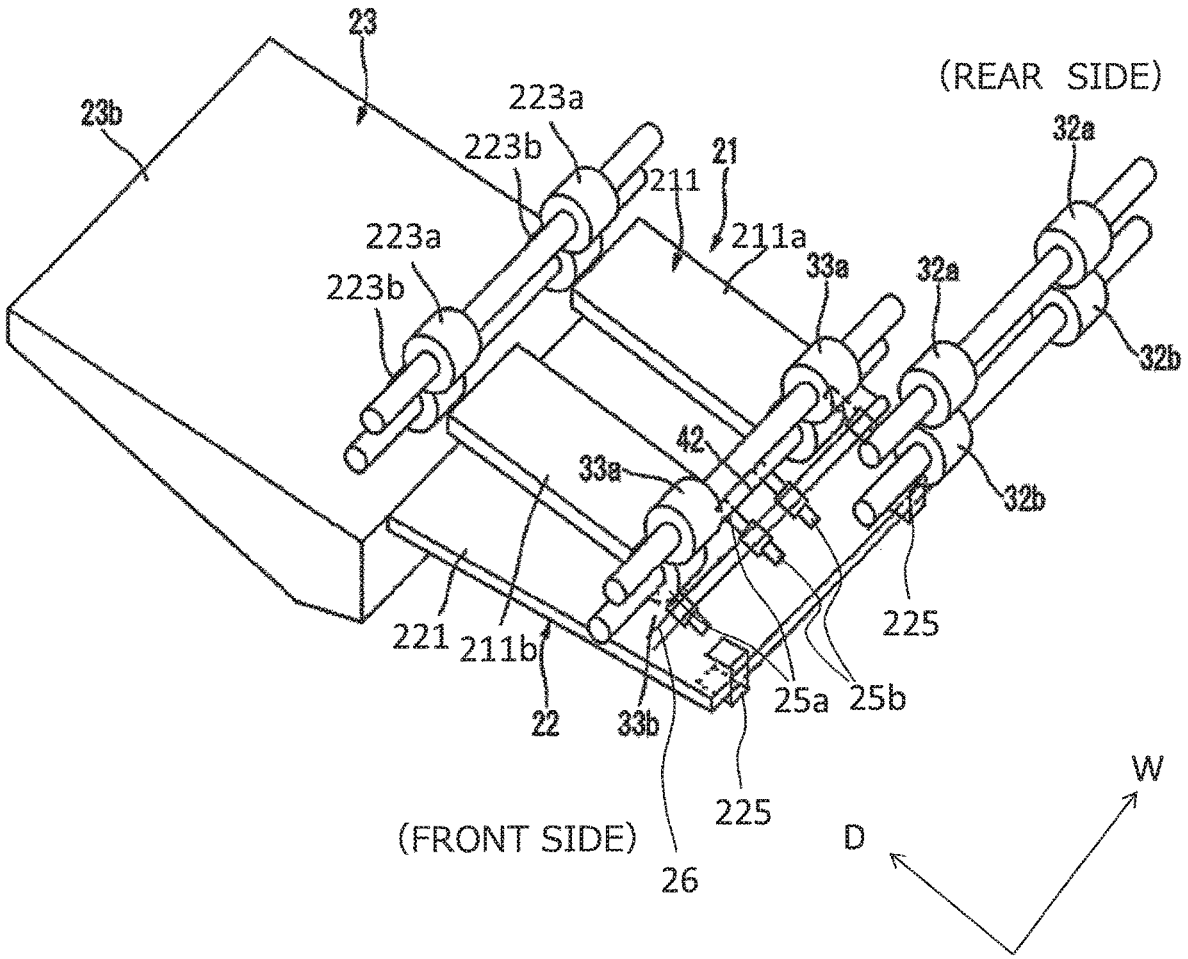
FIG. 4 is a diagram illustrating a relation between a standby tray, a processing tray and a paddle section.

FIG. 4 illustrates a relation between the standby tray 211, the processing tray 221 and the paddle section 25 described below. The standby tray 211 includes a first tray member 211*a* and a second tray member 211*b*. The first tray member 211*a* and the second tray member 211*b* are driven by the opening and closing driving section. The first tray member 211*a* and the second tray member 211*b* move in a mutually approaching direction and in a mutually separating direction in a sheet width direction W.

The first tray member 211*a* and the second tray member 211*b* support the sheet S conveyed from the exit rollers 33*a* and 33*b* in a state in which the first tray member 211*a* and the second tray member 211*b* approach each other. On the other hand, the first tray member 211*a* and the second tray member 211*b* are separated in the mutually separating direction in the sheet width direction W so as to enable the sheet S to move from the standby tray 211 towards the processing tray 221. In this way, the sheet S supported by the standby tray 211 drops from a space between the first tray member 211*a* and the second tray member 211*b* towards the processing tray 221.

An assist arm 41 shown in FIG. 3 is arranged above the standby tray 211. The sheet S discharged from the exit rollers 33*a* and 33*b* enters into the space between the assist arm 41 and the standby tray 211.

The processing section 22 shown in FIG. 3 includes the processing tray 221, a stapler 222, conveyance rollers 223*a* and 223*b*, and a conveyance belt 224, a stopper 225 and a horizontal alignment section 51 (the first alignment member 51*a* and the second alignment member 51*b*).

The processing tray 221 is arranged below the standby tray 211. The processing tray 221 is inclined with respect to the horizontal direction in such a way as to gradually rise towards the downstream side of the sheet conveyance direction D. As for a plurality of sheets S moved to the processing tray 221, the first alignment member 51*a* and the second alignment member 51*b* align the deviation between the sheets S in the sheet width direction W.

The stapler 222 is arranged at an end part of the processing tray 221. The stapler 222 carries out a stapling (binding) processing on a bundle of the plurality of sheets S located on the processing tray 221.

The conveyance rollers 223*a* and 223*b* are arranged at a predetermined interval in the sheet conveyance direction D. The conveyance belt 224 is stretched over the conveyance rollers 223*a* and 223*b*. The conveyance belt 224 is rotated in synchronization with the conveyance rollers 223*a* and 223*b*. The conveyance belt 224 conveys the sheet S between the stapler 222 and the discharge section 23.

The stopper 225 is arranged at the upstream side of the sheet conveyance direction D as can be seen when viewed along the conveyance roller 223*b*. The stopper 225 is a member for receiving an end of the sheets S moved from the standby tray 211 to the processing tray 221 to align them in the sheet conveyance direction D. In other words, the stopper 225 is a member serving as a sheet reference position when an alignment processing in the sheet conveyance direction D is executed. The sheets S moved towards the upstream side of the sheet conveyance direction through a first paddle 25*a* and a second paddle 25*b* described below are struck against the stopper 225 to be aligned in the sheet conveyance direction D. Hereinafter, aligning the sheets in the sheet conveyance direction is referred to as a vertical alignment processing.

The horizontal alignment section 51 includes a pair of the first alignment member 51*a* and the second alignment member 51*b*. The first alignment member 51*a* is located at the front side of the sheet post-processing apparatus 2, and the second alignment member 51*b* is located at the rear side of the sheet post-processing apparatus 2. The first alignment member 51*a* and the second alignment member 51*b* are movable members in a sheet width direction W through the first horizontal alignment motor 29*a* and the second horizontal alignment motor 29*b* separately or independently. The horizontal alignment section 51 can change the position of the sheet S by sliding the first alignment member 51*a* and the second alignment member 51*b* in the sheet width direction W. Thus, the first alignment member 51*a* and the second alignment member 51*b* are also used at the time of sorting the sheet S in the sheet width direction W.

The first alignment member 51*a* and the second alignment member 51*b* are arranged to have a predetermined space (interval). The processing tray 221 loads the sheet S moved from the standby tray 211 in the predetermined space. The first alignment member 51*a* and the second alignment member 51*b* sandwich the sheets S and align edges of sheets S in the sheet width direction W. Further, the first alignment member 51*a* includes a damper. The damper may be a spring type or may be formed with a member molded by a flexible material such as resin.

In FIG. 3, the paddle section 25 includes the first paddle 25*a*, the second paddle 25*b*, a rotational shaft 26 and a rotating member 27.

The rotational shaft 26 rotates around an axis of rotation. The axis of rotation is a rotation center of the first paddle 25*a* and the second paddle 25*b*. The rotational shaft 26 is located below the standby tray 211 and is fixedly mounted on the housing of the sheet post-processing apparatus 2. The rotational shaft 26 extends in the sheet width direction W. The rotational shaft 26 receives driving force from the paddle motor 28 to rotate in an arrow A direction (in a counter-clockwise direction) in FIG. 3.

The first paddle 25*a* and the second paddle 25*b* are formed with an elastic material such as rubber or resin. The first paddle 25*a* protrudes in the diameter direction of the rotating member 27 to be mounted in the rotating member 27.

The first paddle 25*a* has a length L1 in the diameter direction of the rotating member 27.

The second paddle 25*b* is arranged to have a predetermined angle with respect to the first paddle 25*a*. In other words, the second paddle 25*b* is arranged a predetermined distance away from the rear of the first paddle 25*a* in the rotation direction A in FIG. 3. The second paddle 25*b* protrudes in the diameter direction of the rotating member 27 to be mounted in the rotating member 27. The second paddle 25*b* has a length L2 (<L1) in the diameter direction of the rotating member 27. The length L2 of the second paddle 25*b* is shorter than the length L1 of the first paddle 25*a*.

Figure 5:
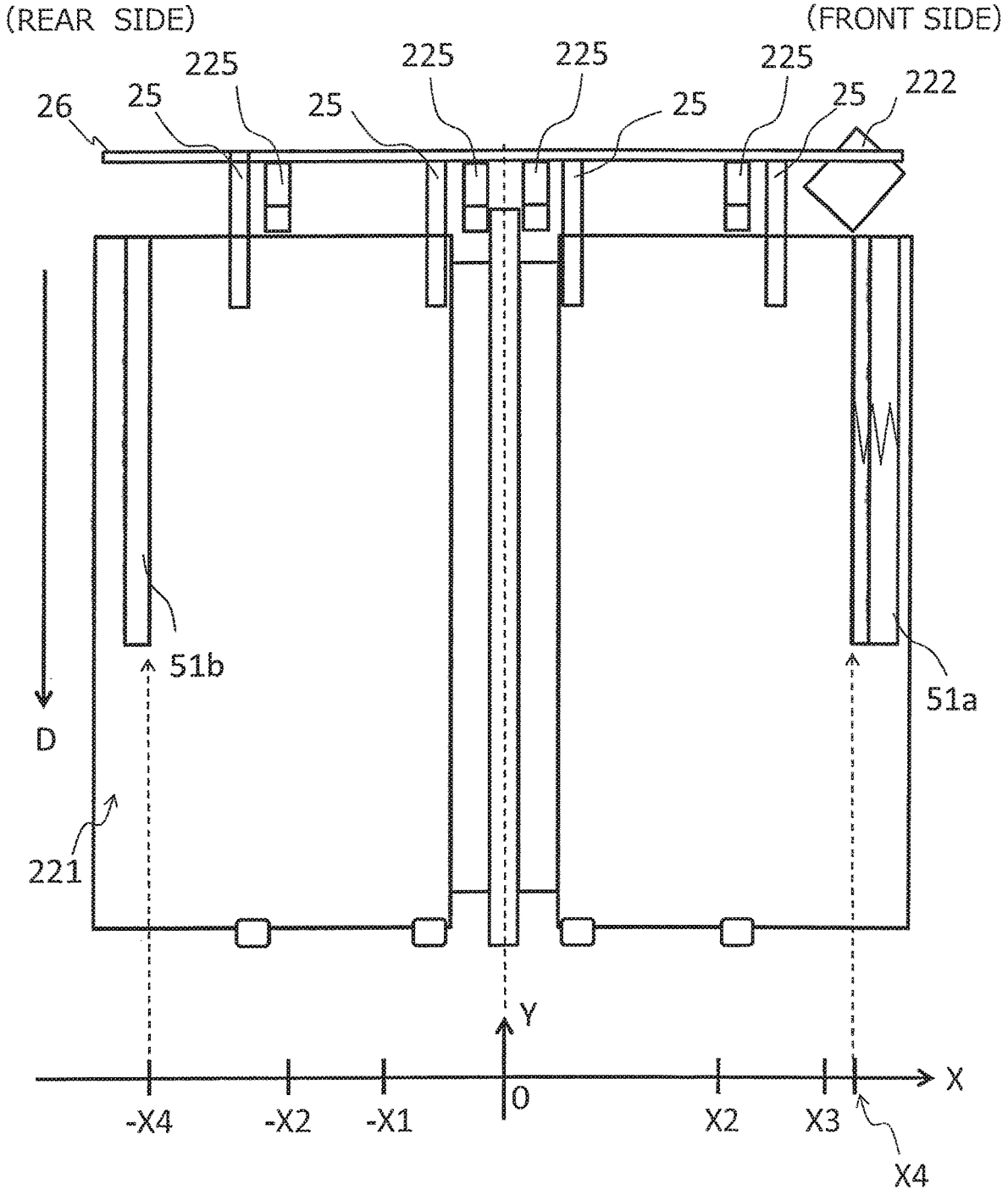
FIG. 5 is top view illustrating a relation between the paddle section and the processing tray.

FIG. 5 is top view illustrating a relation between the paddle section 25 and the processing tray 221.

A plurality of the paddle section 25 are attached the rotational shaft 26 which extends in the sheet width direction W. Further the plurality of the paddle section 25 is disposed on the rotational shaft 26 symmetrically to the center of the processing tray 221. The plurality of the paddle section 25 is disposed on the rotational shaft 26 having a predetermined interval mutually in the sheet width direction.

The first paddle 25 and the second paddle 25*b* are contacted with the surface of the processing tray 221 when they rotate. The paddle section 25 is rotated in synchronizing with rotation of the rotational shaft 26 since the paddle section 25 is attached on the rotational shaft 26.

The horizontal alignment section 51 (the first alignment member 51*a* and the second alignment member 51*b*) are positioned at "standby positions", "first alignment positions" and "second alignment positions" in the processing tray 221. The horizontal alignment section 51 is movable by receiving the driving force from the first horizontal alignment motor 29*a* and the second horizontal alignment motor 29*b*.

"Standby positions" refer to positions at which the first alignment member 51*a* and the second alignment member 51*b* receive the sheet discharged from the exit roller 33*a* and 33*b* or the sheet moved from the standby tray 211. The first alignment member 51*a* and the second alignment member 51*b* are at the standby position in FIG. 5.

"First alignment position" refers to positions at which the first alignment member 51*a* and the second alignment member 51*b* are shifted a predetermined distance from the center of the processing tray 221 in the sheet width direction W. In this position, the sheets are aligned in the sheet width direction W by the first alignment member 51*a* and the second alignment member 51*b*. Further an interval of distance exists between the first alignment member 51*a* and the second alignment member 51*b*. The interval of distance is preset to be a distance equal or slightly shorter than the length of the sheet S serving as an aligned object in the width direction of the sheet S. In FIG. 5, the first alignment position is shown to be a position shifted toward to the area of front side which has the stapler 222. Alternately, the first alignment position may be a position shifted toward the rear side which is opposite from the front side. The center of the processing tray 221 refers to positions at which the value of X coordinate is "0" as shown in FIG. 5.

"Second alignment position" refers to positions at which the first alignment member 51*a* and the second alignment member 51*b* align the sheets in the sheet width direction, on the basis of the center of the processing tray 221. In the second positions, an interval of distance exists between the first alignment member 51*a* and the second alignment member 51*b*. The distance is preset to be a distance slightly wider than the length of the sheet S serving as an aligned object in the width direction W of the sheet S.

In FIG. 5, the value of "−X4", "−X2", "−X1", "X2", "X3", and "X4" are shown in order to illustrate the positions of the first alignment member 51*a* and the second alignment member 51*b*. Herein the value "0" is the center of the processing tray 221 and is a reference position.

Further table 1 illustrates the value of X coordinates which the first alignment member 51*a* and the second alignment member 51*b* are located at each operation position. The value of X coordinates of the center of the processing tray 221 is "0". "X1", "X2", "X3", and "X4" have the relation that is "X1"<"X2"<"X3"<"X4".

Specifically, when the horizontal alignment section 51 is located at the standby positions, the first alignment member 51*a* is located at "X4" in X coordinate and the second alignment member 51*b* is located at "−X4" in X coordinate. The first alignment member 51*a* and the second alignment member 51*b* are located at symmetrically to the center of the processing tray 221.

When the horizontal alignment section 51 is located at the first alignment positions, the first alignment member 51*a* is located at "X3" in X coordinate and the second alignment member 51*b* is located at "−X1" in X coordinate.

When the horizontal alignment section 51 is located at the second alignment positions, the first alignment member 51*a* is located at "X2" in X coordinate and the second alignment member 51*b* is located at "−X2" in X coordinate. In the second alignment positions, the first alignment member 51*a* and the second alignment member 51*b* are located at symmetrically to the center of the processing tray 221. Further the interval between the first alignment member 51*a* and the second alignment member 51*b* are narrower than the interval between them of at standby position.

Next, a series of operations (the vertical alignment processing) of the first paddle 25*a* and the second paddle 25*b* are described with reference to FIG. 6 to FIG. 8.

Figure 6:
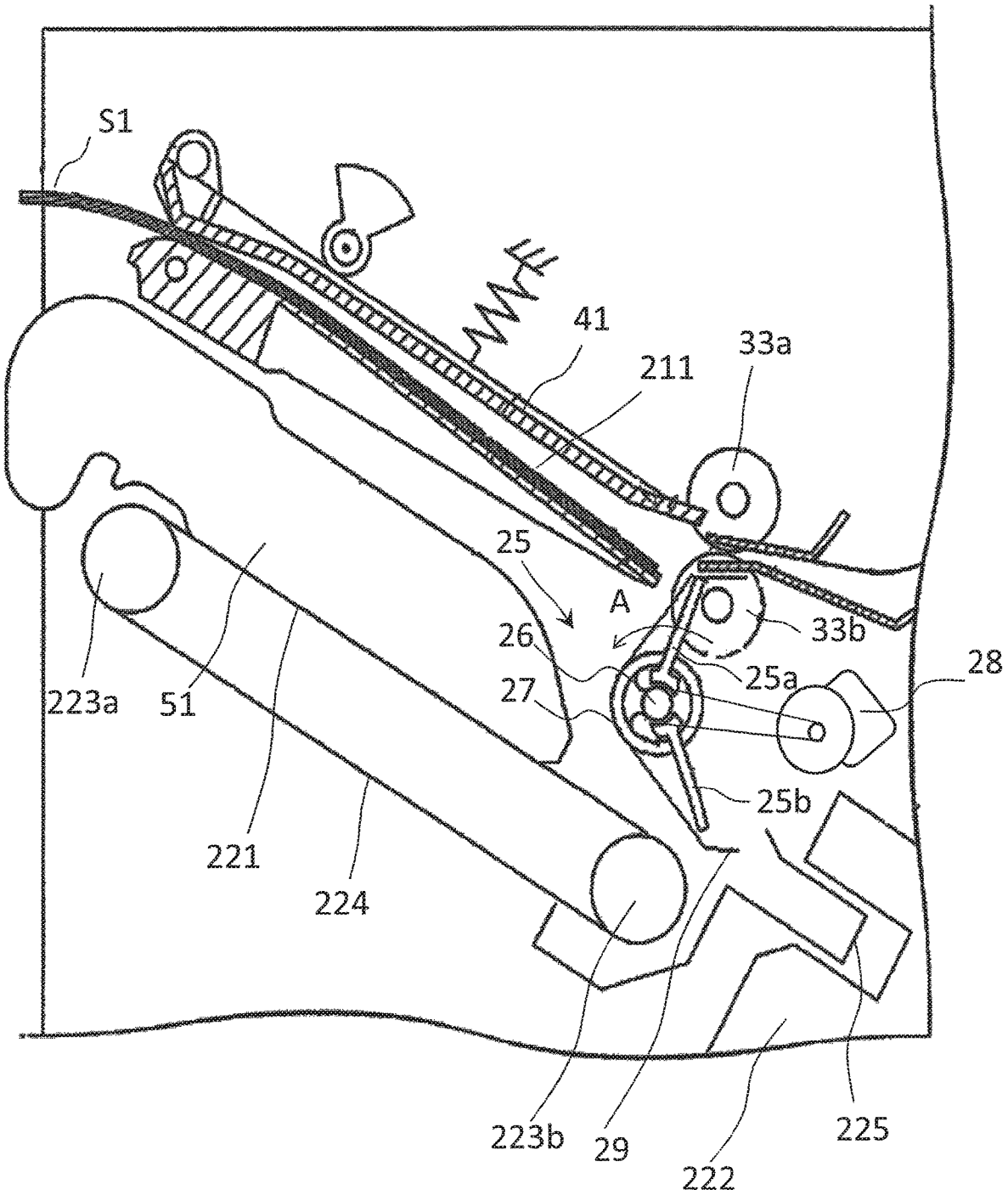
FIGS. 6-8 illustrate an action of the paddle.

FIG. 6 is a diagram illustrating home positions before the first paddle 25*a* and the second paddle 25*b* are driven to rotate. The "home positions" refer to positions at which the first paddle 25*a* and the second paddle 25*b* stand by when the sheet S is conveyed from the exit rollers 33*a* and 33*b* towards the standby tray 211 to be stacked or the sheet S is directly conveyed from the exit rollers 33*a* and 33*b* to the processing tray 221.

In FIG. 6, the first paddle 25*a* is arranged at a position at which the first paddle 25*a* does not protrude towards the downstream side of the sheet conveyance direction D with respect to the outer peripheral surface of the exit roller 33*b* can be seen when viewed from an axis 33*c* of the exit roller 33*b*. From a different point of view, can be seen when viewed from the standby tray 211, the first paddle 25*a* is located at the upstream side of the conveyance direction with respect to the outer peripheral surface of the exit roller 33*b* located in the vicinity of the standby tray 211 and is arranged at a position at which the conveyance of the sheet S conveyed from the exit roller 33*b* to the standby tray 211 is not disturbed. The second paddle 25*b* is arranged at a position at which the front end part is apart from the sheets S on the processing tray 221 at a predetermined distance.

The controller 24 drives a pair of the standby tray members 211*a* and 211*b* in the mutually separating direction in the sheet width direction W to move the buffered sheets S to the processing tray 221, if the predetermined number of sheets S is stacked on the standby tray 211.

The controller 24 drives the paddle motor 28 to rotate the rotational shaft 26. The first paddle 25*a* is rotated with the rotation of the rotational shaft 26 and contacts with the sheet S dropped from the standby tray 211. Then the first paddle 25*a* forces the sheets S towards the processing tray 221.

Figure 7:
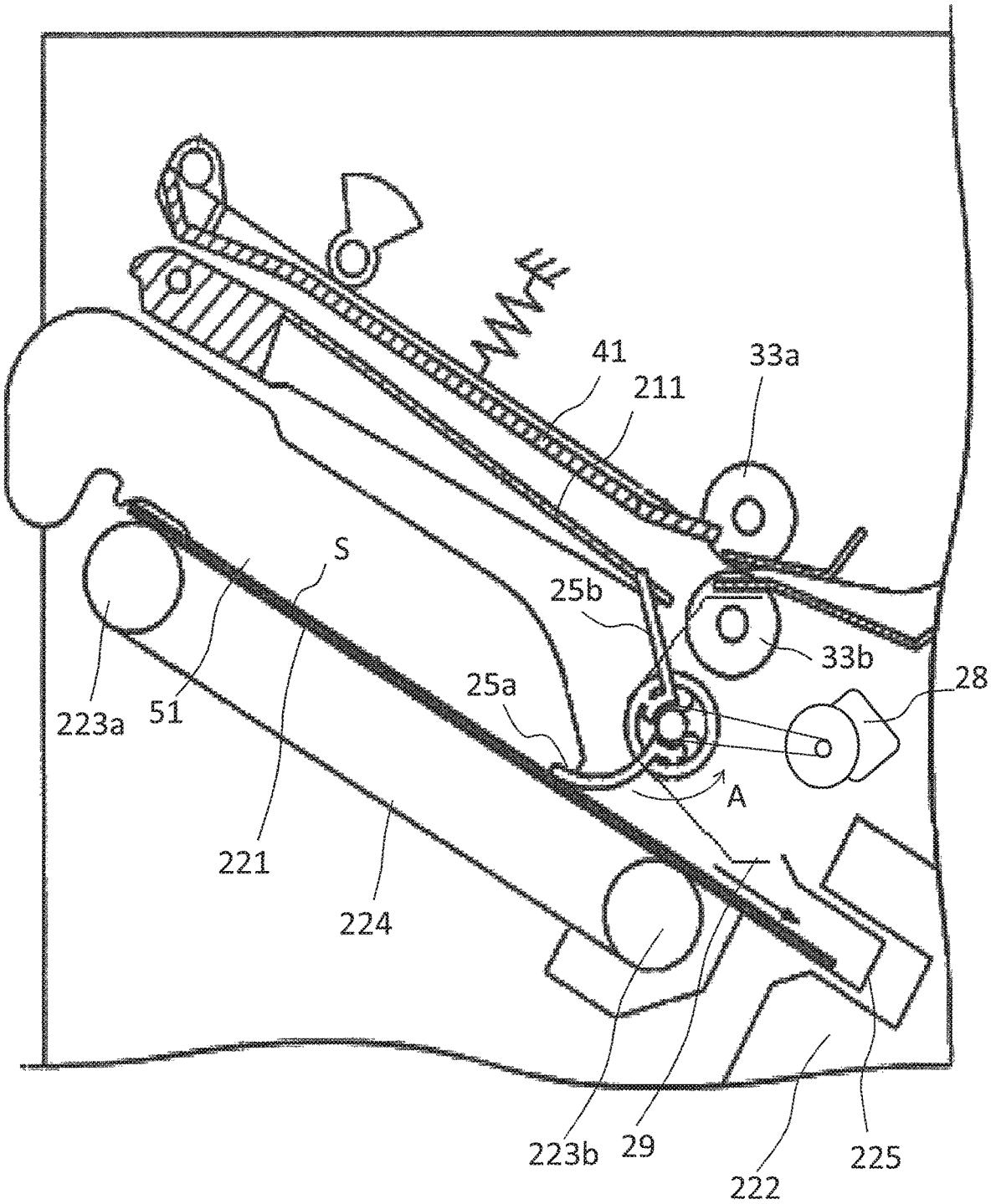

FIG. 7 illustrates an operation of the vertical alignment processing to the sheets S on the processing tray 221 by the first paddle 25*a* through the further rotation of the first paddle 25*a* in the arrow A direction (in the counter-clockwise direction).

The first paddle 25*a* is further rotated in the arrow A direction to guide the sheet S onto the processing tray 221 from the state shown in FIG. 6. The first paddle 25*a* contacts with the processing tray 221 across the sheet S and then becomes a bent state. The first paddle 25*a* is rotated in the arrow A direction to be kept in the bent state. The first paddle 25*a* moves the sheet S towards the stopper 225 located at the upstream side of the sheet conveyance direction from the processing tray 221. In other words, the first paddle 25*a* sandwiches a plurality of the sheets S together with the processing tray 221. The first paddle 25*a* draws the sheets S into the stopper 225 to carry out the vertical alignment processing. Then the controller 24 controls rotation of the rotational shaft 26 to suspend the first paddle 25*a* and the second paddle 25*b* after the first paddle 25*a* separates from the sheets and before the second paddle 25*b* contacts with the sheets.

Figure 8:
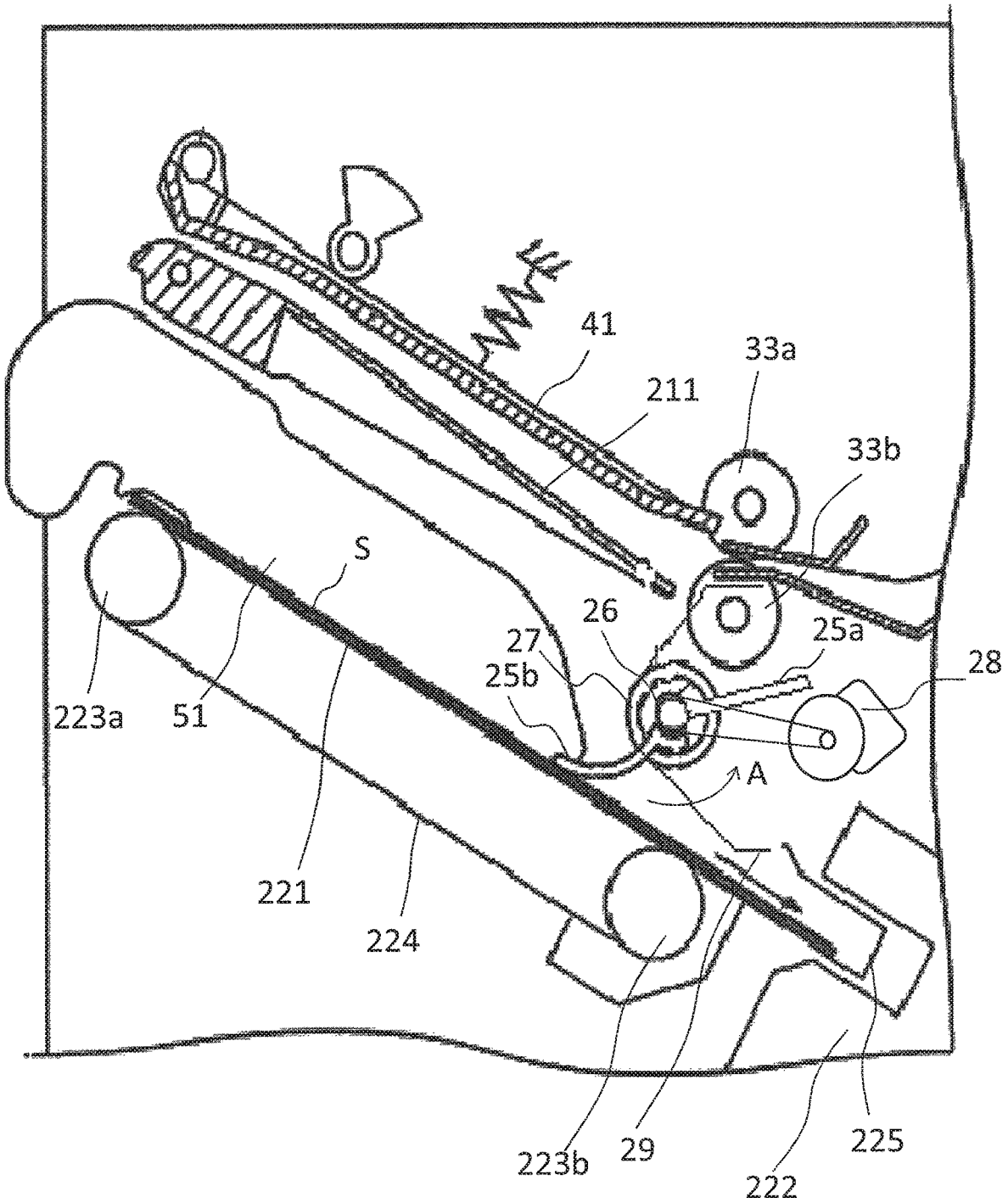

FIG. 8 illustrates an operation of the vertical alignment processing to the sheets S on the processing tray 221 by the second paddle 25*b*. The controller 24 controls the drive of the paddle motor 28. The controller 24 controls the first paddle 25*a* and the second paddle 25*b* to rotate from the state in FIG. 7 to in the arrow A direction. The first paddle 25*a* and the second paddle 25*b* are rotated by receiving the drive from the paddle motor 28. The second paddle 25*b* performs the vertical alignment processing for the sheets again which previously performed the vertical alignment processing.

Then, the controller 24 controls the paddle motor 28 and positions the first paddle 25*a* and the second paddle 25*b* at the home positions (See FIG. 6).

The first paddle 25*a* and the second paddle 25*b* wait for that the following sheets are received by the standby tray 211 in a state where they are located at the home positions. The above explanation is the series of operation of the vertical alignment processing by the first paddle 25*a* and the second paddle 25*b*.

Next, the flow of the horizontal alignment processing and the vertical alignment processing for the sheets on the processing tray 221 by the horizontal alignment section 51 (the first alignment member 51*a* and the second alignment member 51*b*) and the paddle section 25 is described.

Figure 9:
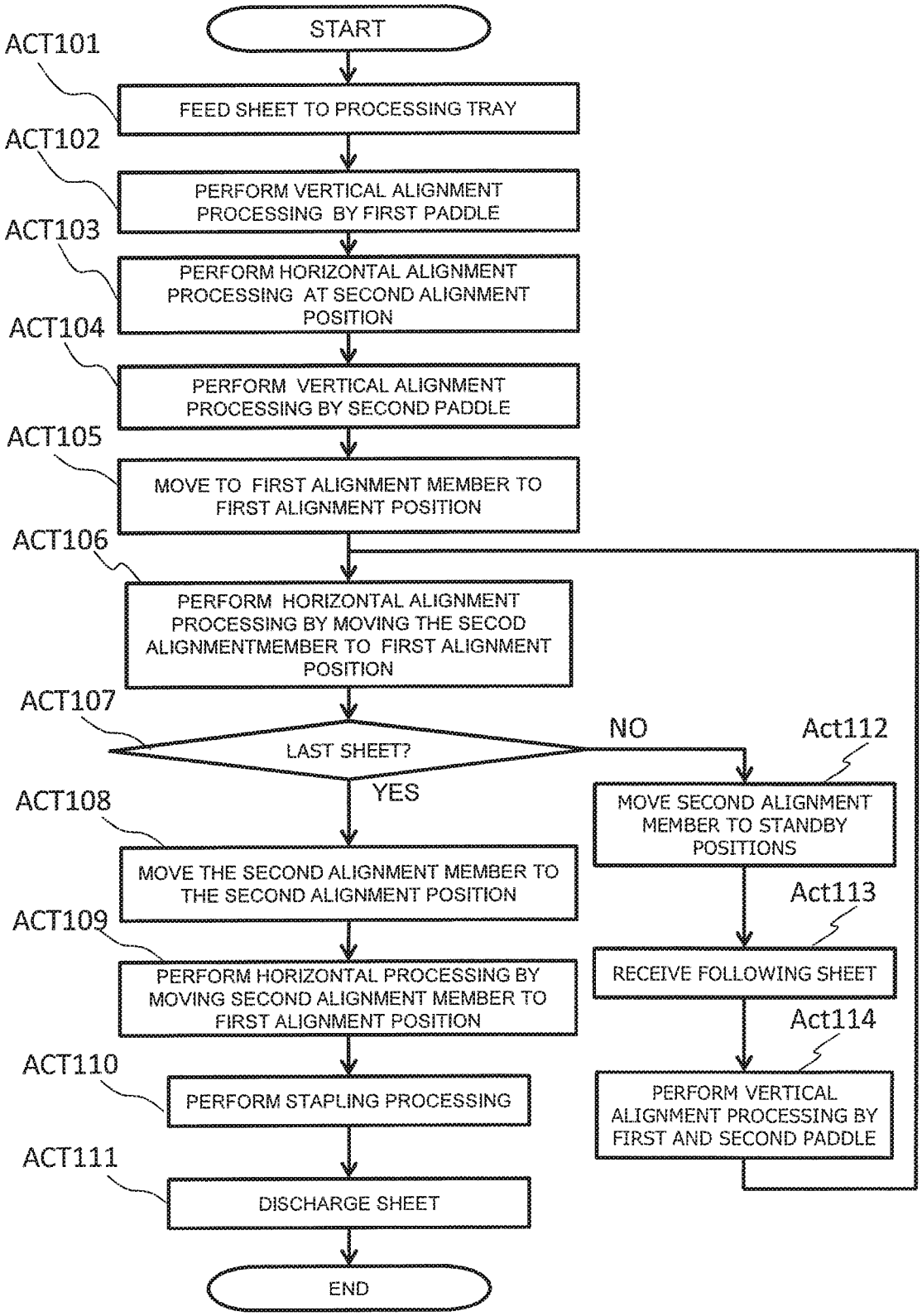
FIG. 9 illustrates a control performed by a processor.

FIG. 9 is a flowchart illustrating the vertical alignment processing and the horizontal alignment processing executed by the horizontal alignment section 51 and the paddle section 25 under the control of the controller 24.

Figure 10:
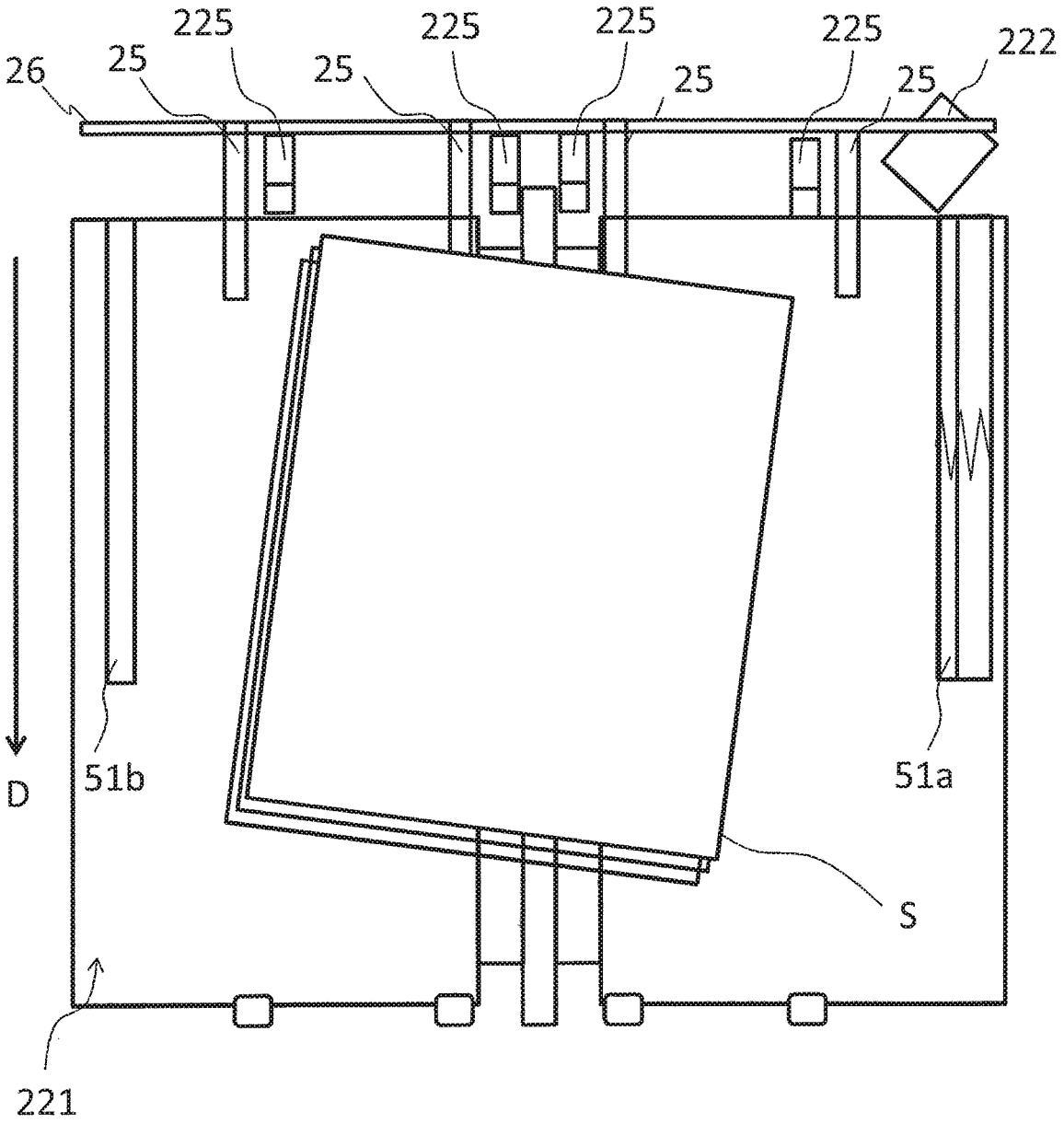
FIGS. 10-18 illustrate an action on the sheets loaded on the processing tray.

The sheet S is discharged from the exit roller 33*a* and 33*b* to the standby tray 211. The standby tray 211 buffers the plurality of sheets (for example three sheets) discharged from the exit roller 33*a* and 33*b*. The controller 24 controls the first tray member 211*a* and the second tray member 211*b* to be separated in the mutually separating direction in the sheet width direction W to enable the sheet S to move from the standby tray 211 towards the processing tray 221 (ACT 101). The plurality of sheets is dropped from the standby tray 211 to the processing tray 221. In FIG. 10, the first alignment member 51*a* and the second alignment member 51*b* wait for the plurality of sheets which dropped from the standby tray 211 to the processing tray 221, at standby position on the processing tray 221.

Figure 11:
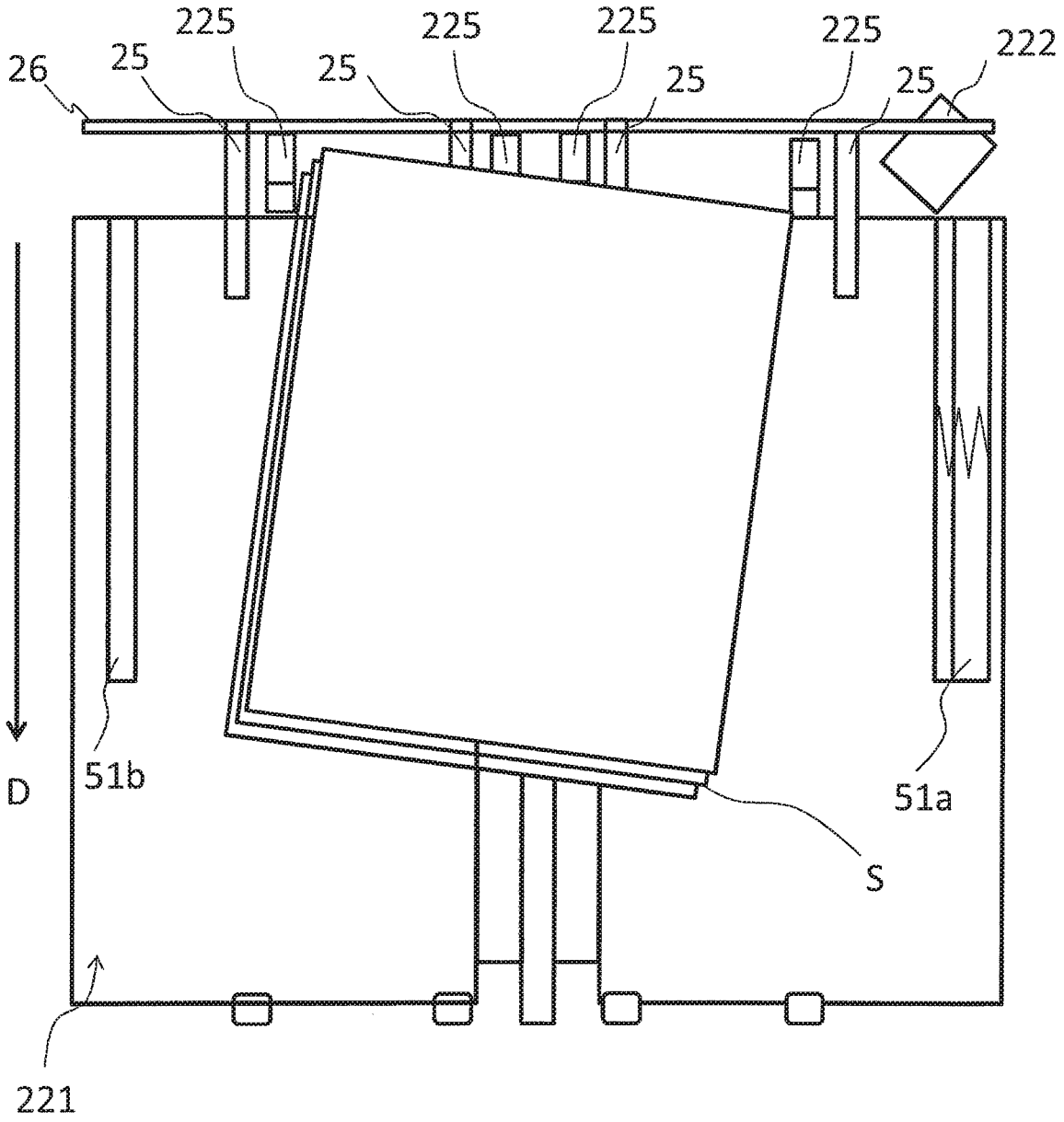

The controller 24 controls the paddle section 25 to rotate. The controller 24 performs the vertical alignment processing (See FIG. 7) for the plurality of sheets S by the first paddle 25*a* (ACT 102). In FIG. 11, the sheets S are moved toward an upward of the conveyance direction D by the first paddle 25*a*.

Figure 12:
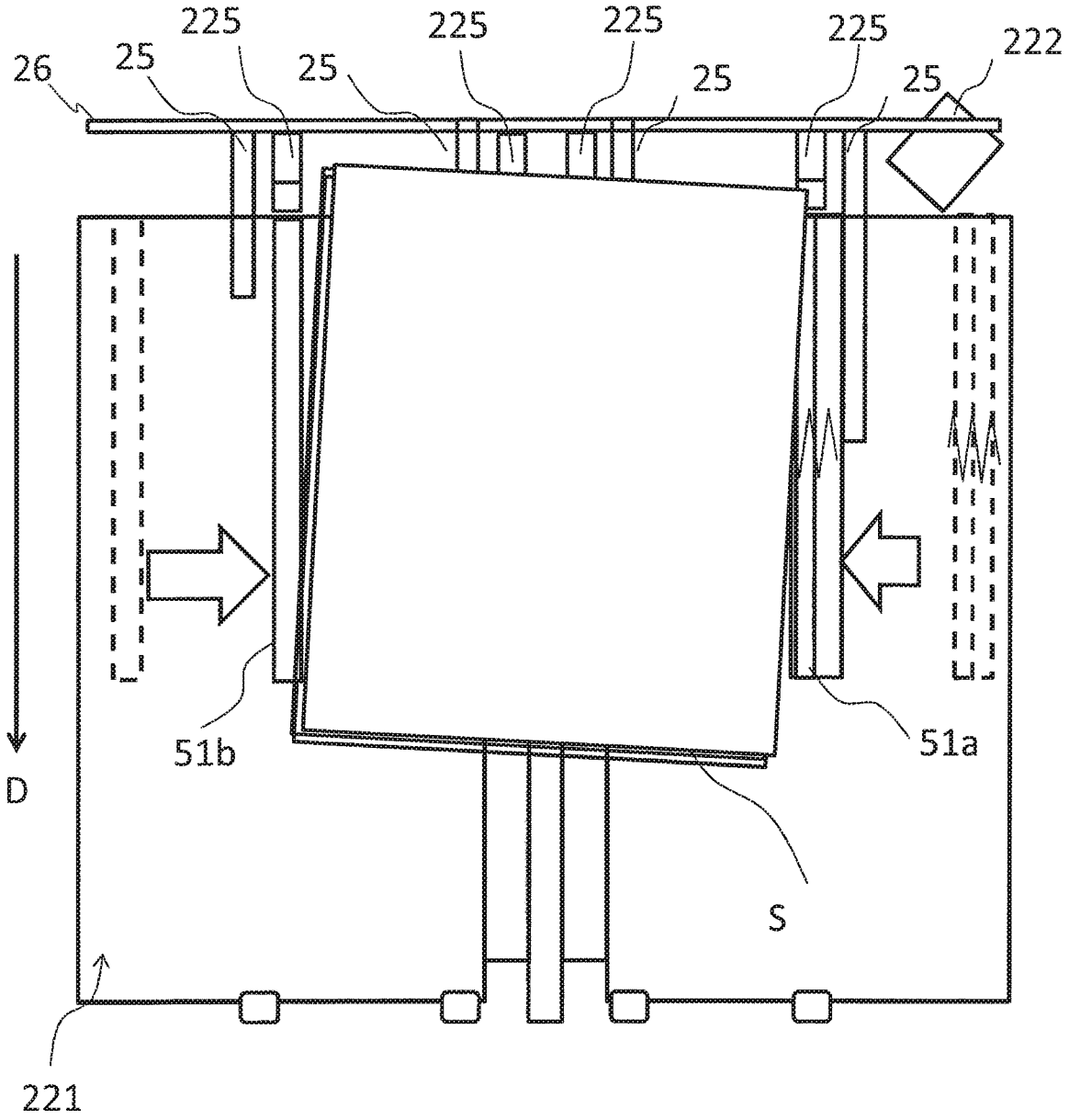

In FIG. 12, the controller 24 moves the first alignment member 51*a* and the second alignment member 51*b* from standby positions to the second alignment positions and performs the horizontal alignment processing for the sheets at the second alignment position (ACT 103). The plurality of sheets which performed the vertical alignment processing in ACT 102 are aligned in the sheet width direction W at the second alignment position, by the first alignment member 51*a* and the second alignment member 51*b*.

Figure 13:
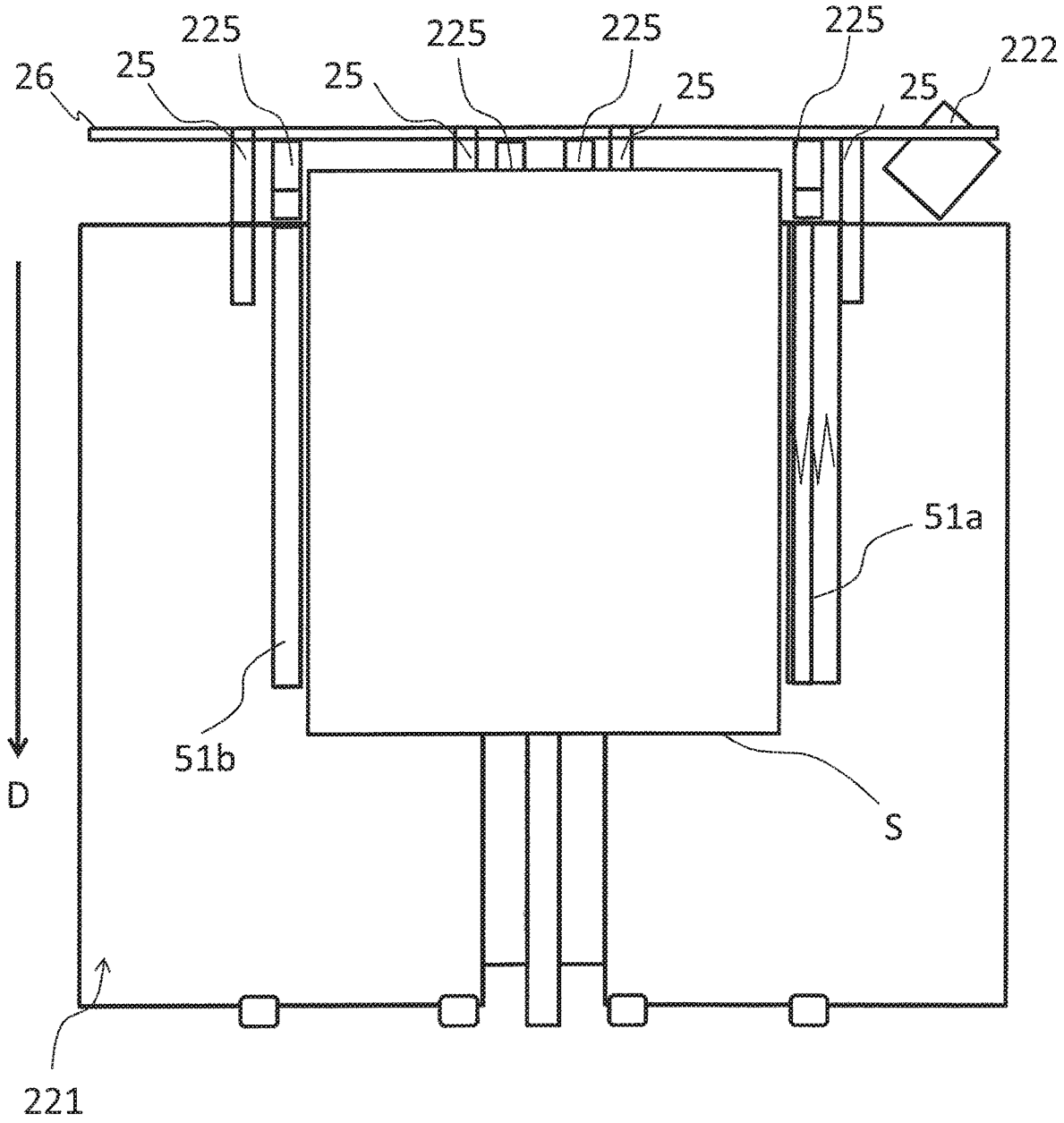

In FIG. 13, the controller 24 performs the vertical alignment processing (See FIG. 8) for plurality of the sheets which aligned at the second alignment position, by the second paddle 25*b* (Act104). The first alignment member 51*a* and the second alignment member 51*b* are positioned at the second alignment positions at the time of the vertical alignment processing. Thus, the deviation between the sheets in the sheet width direction W can be suppressed.

Figure 14:
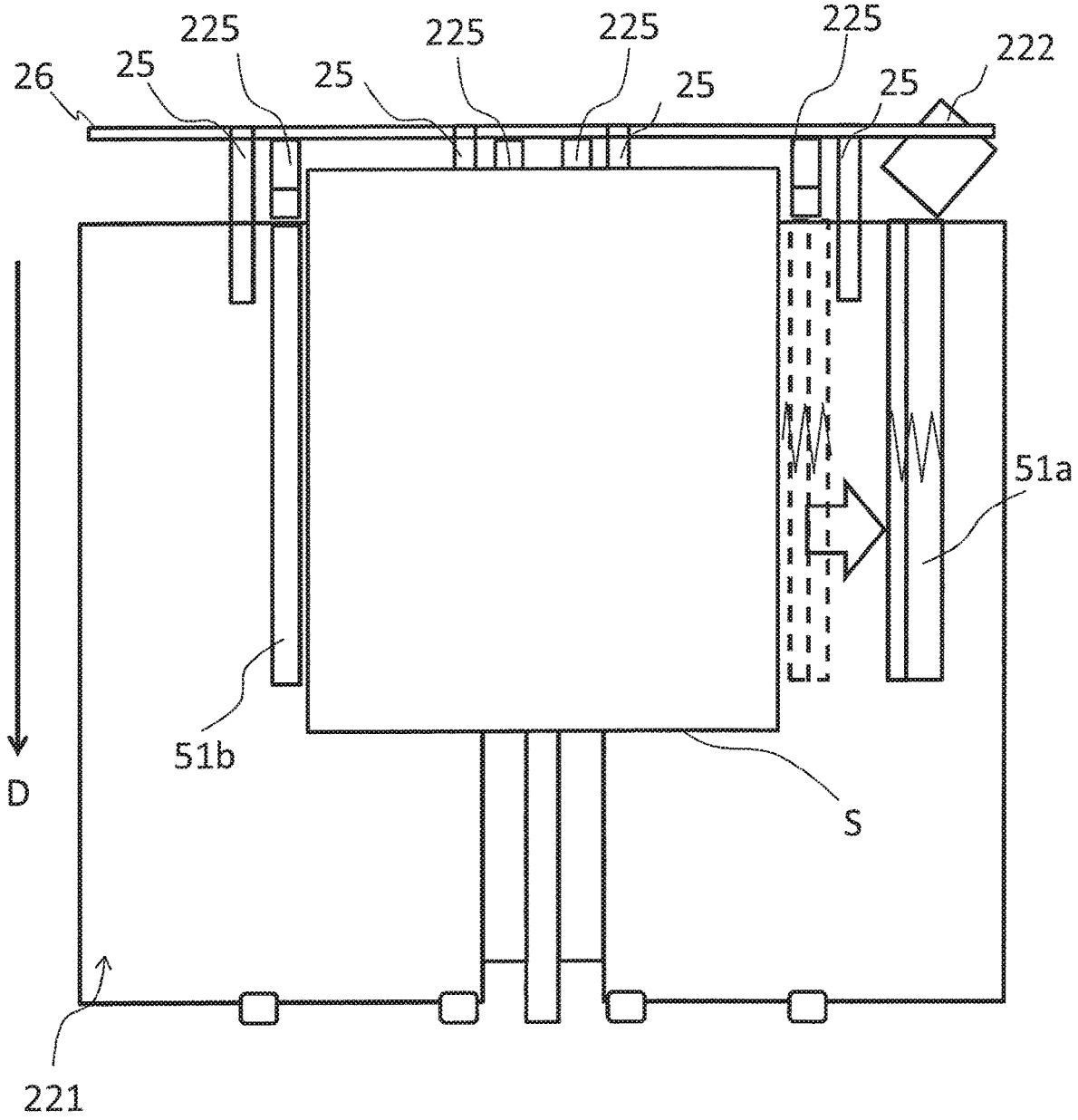

In FIG. 14, the controller 24 moves the first alignment member 51*a* from the second alignment position to the first alignment position (ACT 105). The second alignment member 51*b* waits for a following process at the second alignment position.

Figure 15:
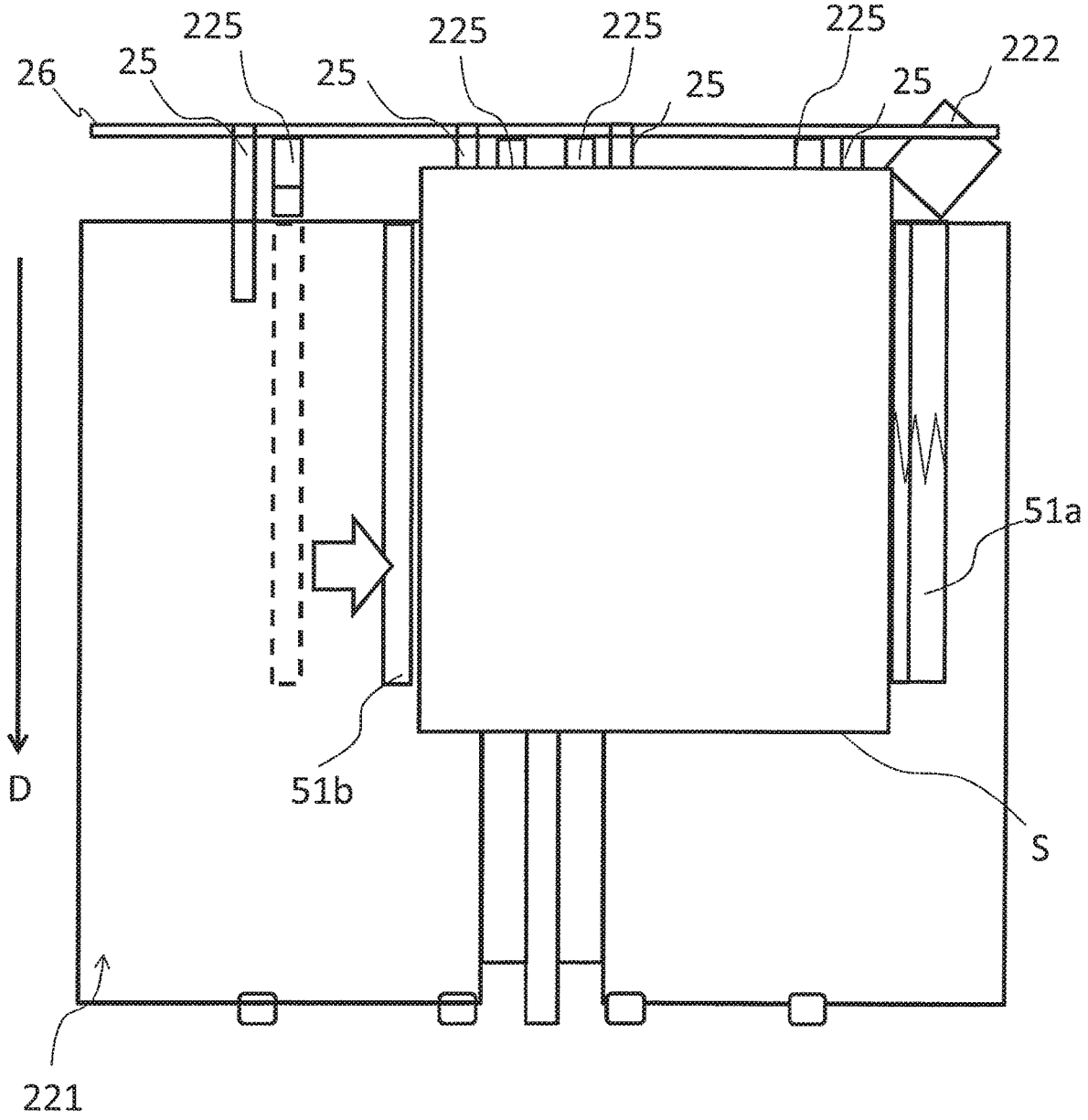

In FIG. 15, the controller 24 moves the second alignment member 51*b* from the second alignment position to the first alignment position (ACT 106). The second alignment member 51*b* can shift the sheets from the second alignment position to the first alignment position. Further the second alignment member 51*b* can align the sheets with the first alignment member 51*a* in the sheet width direction W since the first alignment member 51*a* is located at the first alignment position. In other words, the controller 24 performs the horizontal alignment processing for sheets at the first alignment position by the first alignment member 51*a* and the second alignment member 51*b*.

At the time, the controller 24 performs the horizontal alignment processing for the sheets by abutting against the second alignment member 51*b* which does not include a dumper mechanism. That is, sheets are aligned at the end of the second alignment member 51*b* side of the sheet as a reference.

The controller 24 determines whether a current performing sheet is a last sheet (Act 107). The controller 24 performs the processing of Act 112, if the controller 24 determines the current performing sheet is not the last sheet (NO in ACT 107).

Figure 16:
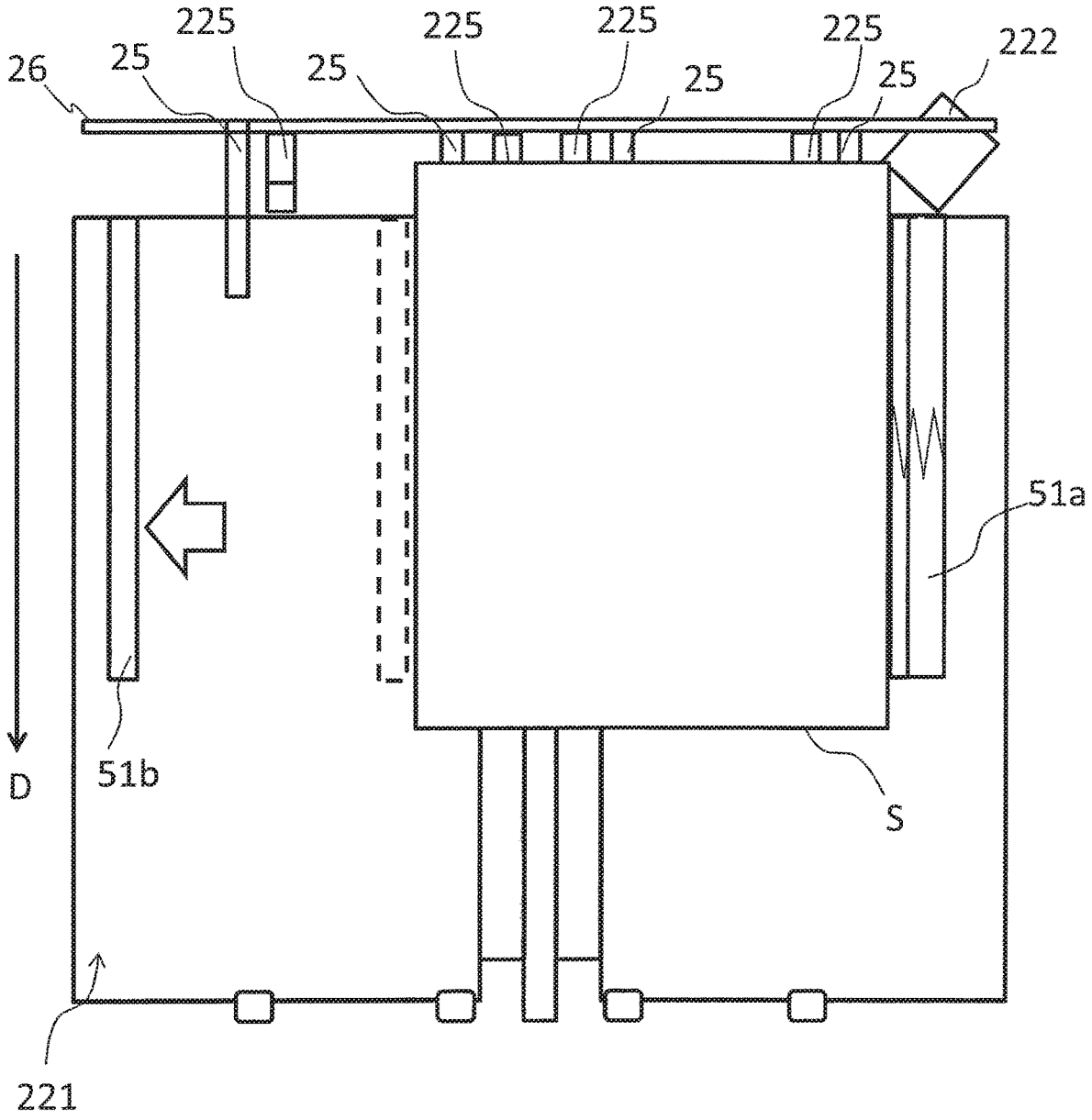

In FIG. 16, the controller 24 moves the second alignment member 51*b* from the first alignment position to the standby positions so as to load a following sheet S' on the processing tray 221 (Act 112). The first alignment member 51*a* waits for a following process at the first alignment position.

Figure 17:
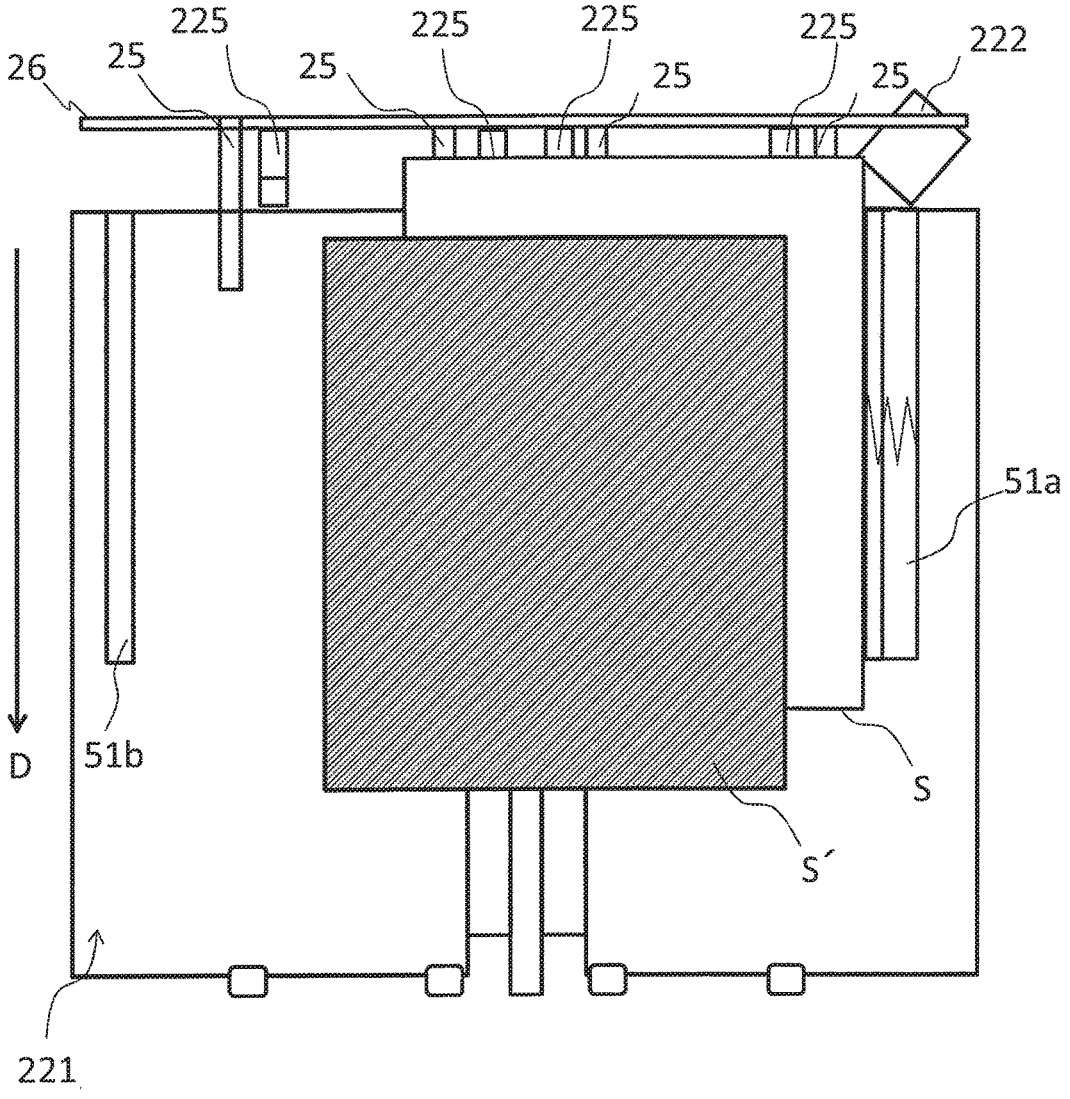

In FIG. 17, the controller 24 controls the exit rollers 33*a* and 33*b* to convey the following sheet 5' to the processing tray 221 (Act 113). When the following sheet 5' is conveyed to the processing tray 221, the first alignment member 51*a* is located at the first alignment position and the second alignment member 51*b* is located at standby positions.

The controller 24 controls the paddle section 25 to rotate when the following sheet 5' is conveyed to the processing tray 221. The controller 24 performs the vertical alignment processing for the sheet (See FIG. 7,8) by the first paddle 25*a* and the second paddle 25*b* (ACT 114).

Figure 18:
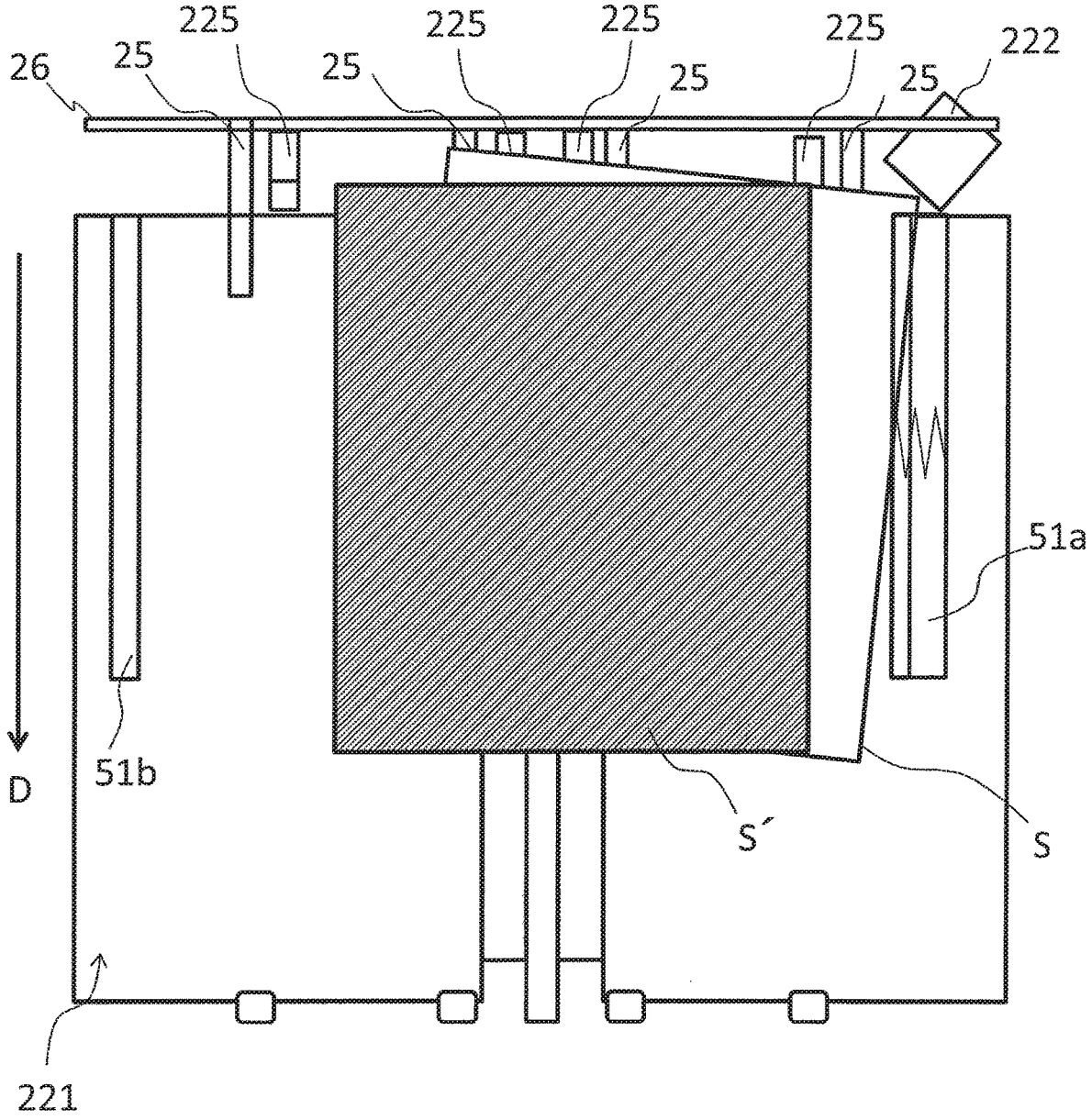

In FIG. 18, the following sheet 5' is moved to the upward side in the sheet conveying direction D by above the vertical alignment processing. On the other hands, since the plurality of the sheets already aligned is located at the first alignment position on the processing tray, the conveyance force against the plurality sheets applied by the paddle section 25 becomes an uneven in the sheet width direction W. As the result, the state of the plurality of the sheets already aligned becomes failure (See FIG. 18).

Figure 19:
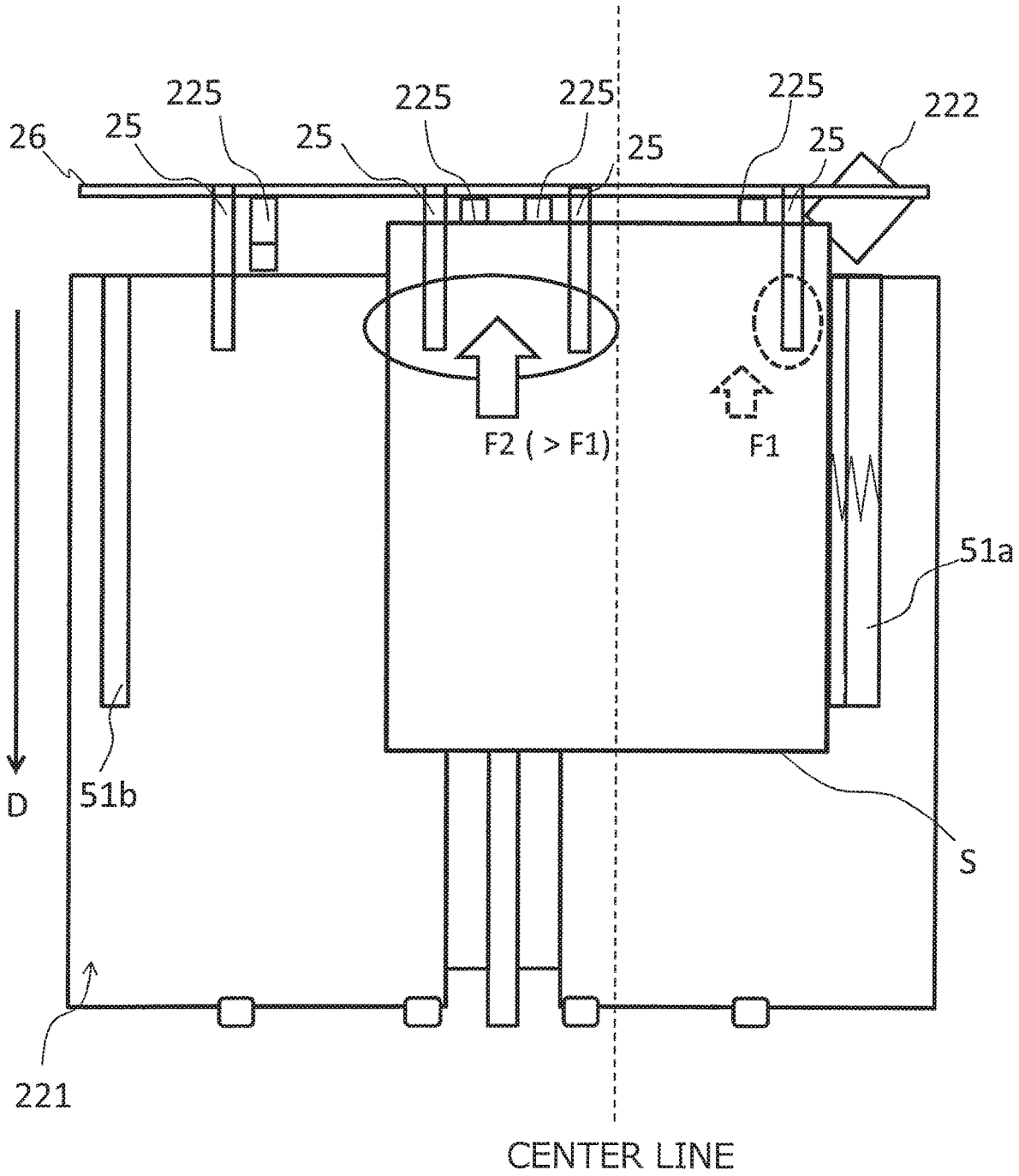
FIG. 19 illustrates a phenomenon of sheet deviation which is occurred by performing a vertical alignment processing at a first alignment position.

In FIG. 19 illustrates that the states of the plurality of the sheets already aligned at the first alignment position becomes failure when the controller performs the processing of ACT 114.

The plurality of the sheets is aligned at the first alignment position which is shifted to the other ends sides predetermined distance from the center of the processing tray 221. Thus, when the paddle section 25 performs the vertical processing for sheets, the number of the paddle section 25 which contact with the sheets on the processing tray 221 becomes uneven in the sheet width direction W.

Specifically, in FIG. 19, in the area of left side with respect to the center line, the number of the paddle section 25 which contacts with the sheets is 2. The conveyance force F2 arise in the left area in FIG. 19 and the sheet post-processing apparatus 2 performs the vertical alignment processing for the sheets at the force F2 in the area of left side.

On the other hands, in the area of right side with respect to the center line in FIG. 19, the number of the paddle section 25 which contacts with the sheets is 1. The conveyance force F1 arises in the right area in FIG. 19. The sheet post-processing apparatus 2 performs the vertical alignment processing at the force F1 in the area of right side. The force F1 is less than the force F2 since a conveyance force applied by one paddle section is even.

Thus, the entire conveyance force applied by post-processing apparatus 2 becomes uneven in the sheet width direction w. Thus, the states of the plurality of the sheets already aligned at the first alignment position becomes failure (as shown in FIG. 18) when the controller performs the processing of ACT 114.

Figure 20:
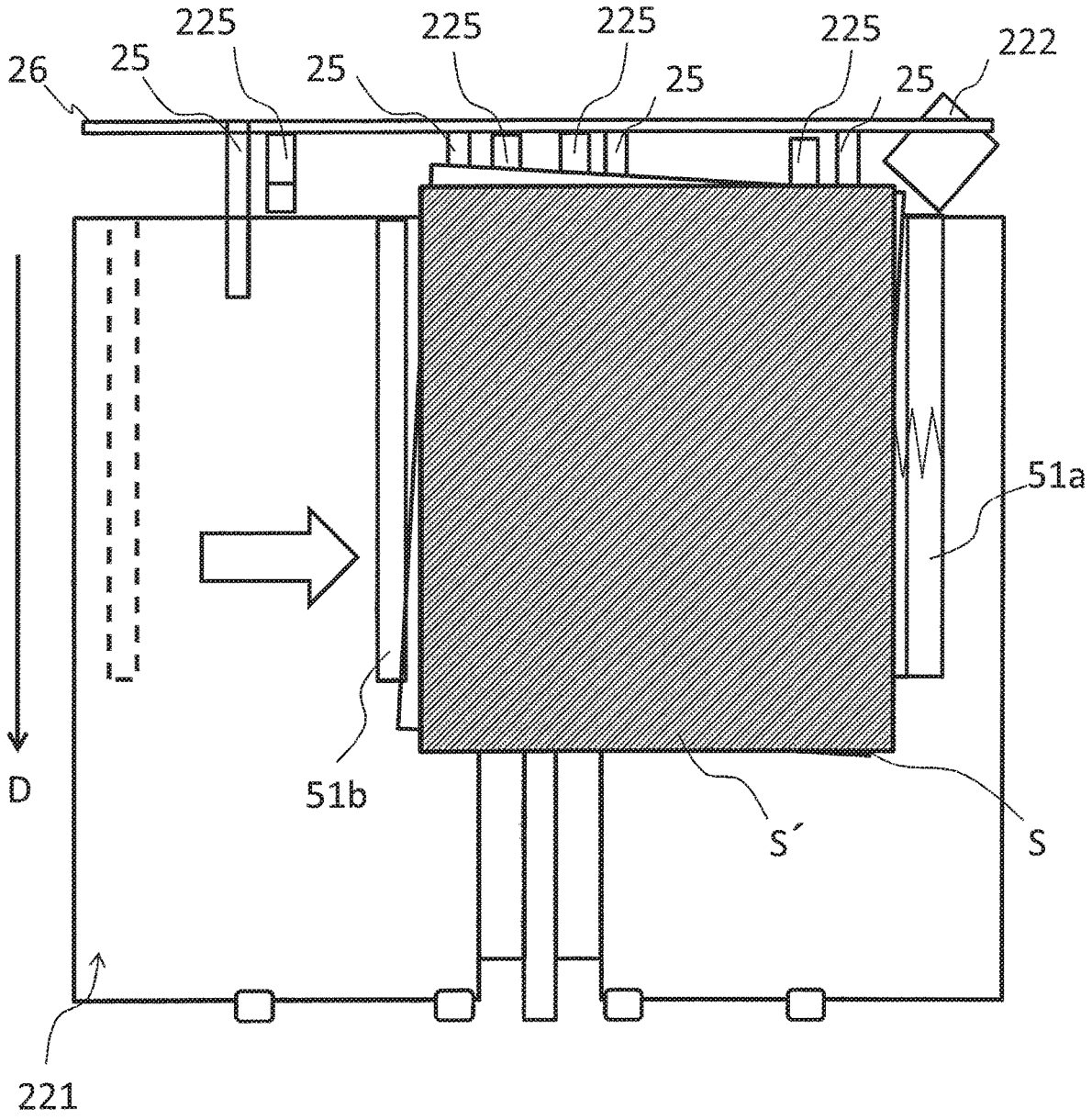
FIGS. 20-22 illustrate the processing for the sheets on the processing tray performed by the horizontal alignment member and the paddle.

In FIG. 20, the controller 24 move the second alignment member 51*b* from the standby positions to the first alignment position (ACT 106) after the controller 24 performs processing ACT 114. At that time, the first alignment member 51*a* is located at the first alignment positons. Thus, the first alignment member 51*a* can perform the horizontal alignment processing by sandwiching the following sheet S' and the plurality of sheets positioned at the first alignment position with the second alignment member 51*b*.

The controller 24 determines whether a current sheet is last sheet again (ACT 107). The controller 24 performs the processing of ACT 108 if the controller 24 determines the current sheet is the last sheet (Yes in ACT 107).

Figure 21:
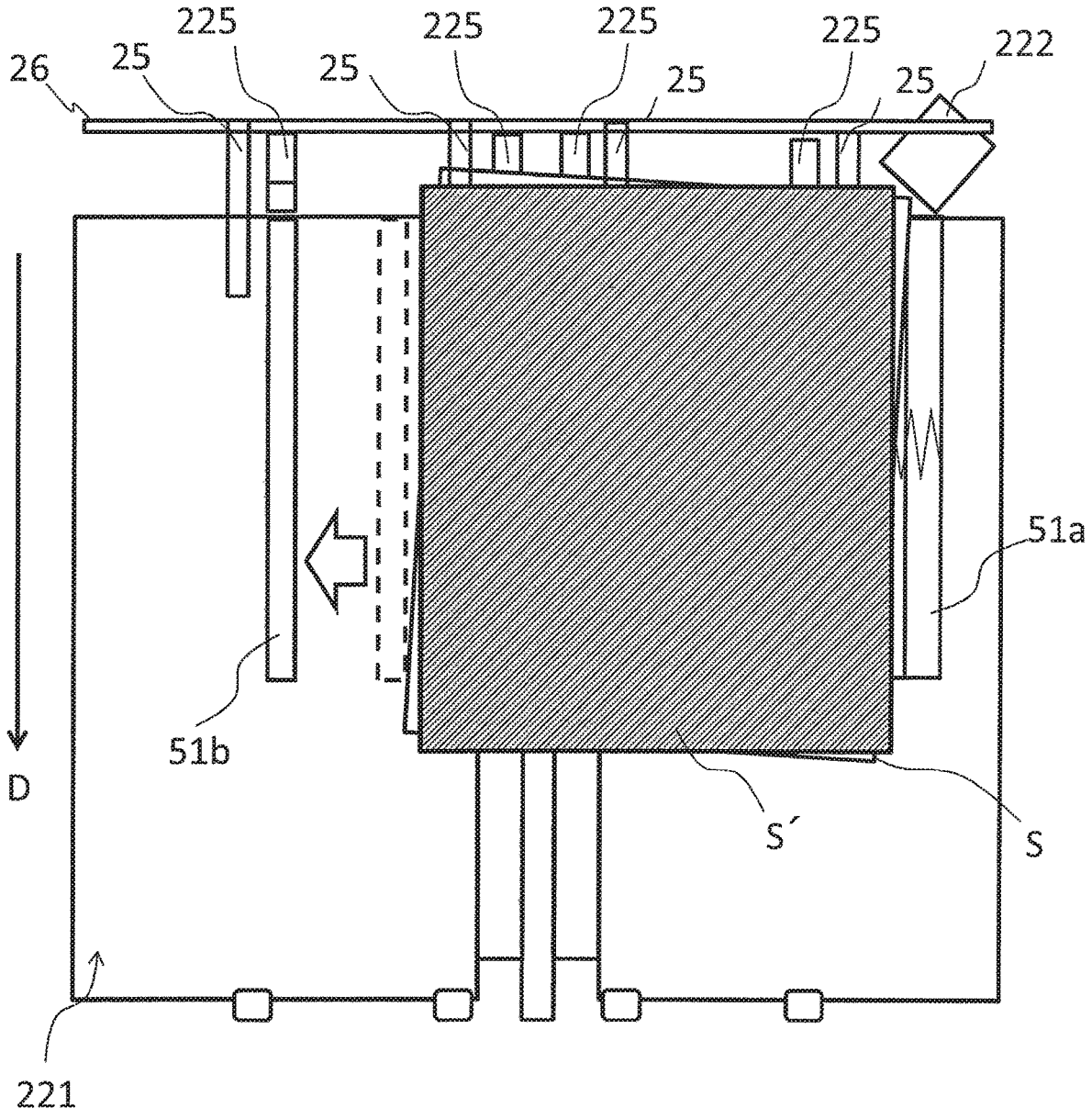

In FIG. 21, a deviation of the sheets might not be improved by only performing the horizontal alignment processing in ACT 106. Therefore, the controller 24 moves the second alignment member 51*b* from the first alignment position to the second alignment position (ACT 108). The first alignment member 51*a* waits for a following process at first alignment position. It is not necessary to move the second alignment member 51*b* to the second alignment position. The second alignment member 51*b* may move to a position wherein an interval between the first alignment member 51*a* and the second alignment member 51*b* is wider. For example, the certain position may be intermediate between the first alignment position and the second alignment position.

Figure 22:
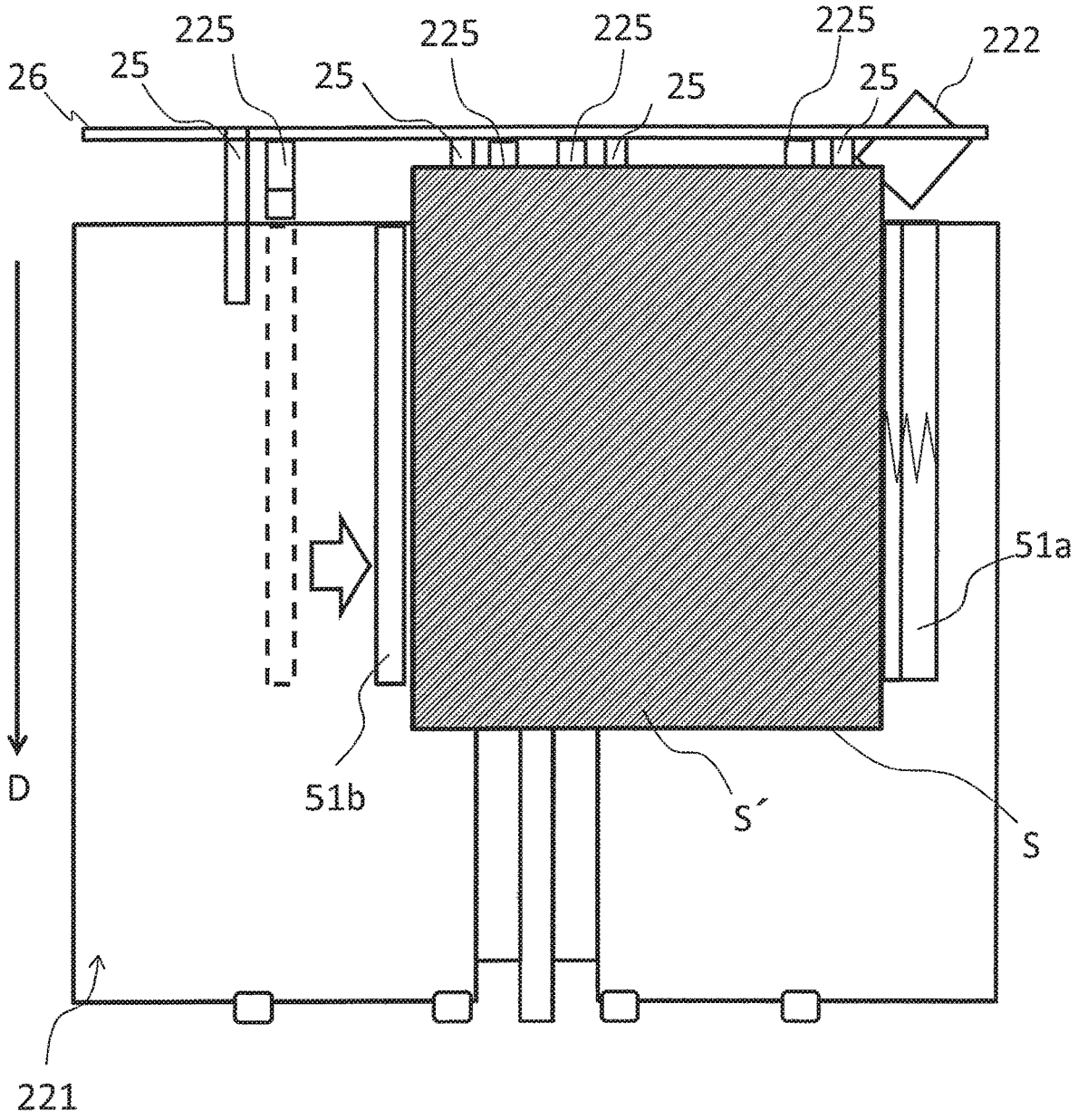

In FIG. 22, the controller 24 moves the second alignment member 51*b* from the second alignment position to the first alignment position (ACT 109). The second alignment member 51*a* and the second alignment member 51*b* can perform the horizontal alignment processing at the first alignment position by sandwich the sheets again.

As above, the sheet post-processing apparatus 2 performs a plurality of the horizontal alignment processing at the first alignment position after the vertical alignment processing by the paddle section 25 is performed. Thus, the sheet post-processing apparatus 2 can improve the deviation of the sheets on the processing tray 221 and discharge a bundle of the sheet aligned to the discharge section.

The controller 24 controls the stapler 222 to perform the stapling processing for the plurality of sheets aligned at the first alignment position by driving the stapler 222 (ACT 110).

The controller 24 controls the conveyance rollers 223*a* and 223*b* to discharge the sheets stapled to the movable tray 23*b* (ACT 111). A series of processing is finished.

According to the embodiment, the sheet post-processing apparatus 2 performs a plurality of the horizontal alignment processing at the first alignment position after the vertical alignment processing by the paddle section 25 is performed. Thus, the sheet post-processing apparatus 2 can improve the deviation of the sheets on the processing tray 221 and discharge a bundle of the sheet aligned to the discharge section.

Further, the sheet post-processing apparatus 2 performs the horizontal alignment processing in advance in ACT 103 before the sheet post-processing apparatus 2 performs the horizontal alignment processing for the sheets in ACT 106 and ACT 109. Thus, the sheet post-processing apparatus 2 can shift the plurality of the sheets aligned to the other end side on the processing tray 221. Accordingly, in ACT 114, when the sheet post-processing apparatus 2 performs the vertical alignment processing for the sheet, the sheet post-processing apparatus 2 can prevent the deviation of the sheets from occurring.

The Second Embodiment

In the second embodiment, the sheet post-processing apparatus 2 changes the number of the horizontal alignment processing for the sheets which performed the vertical alignment processing at the first alignment position, based on the number of sheet to be supposed to process.

Figure 23:
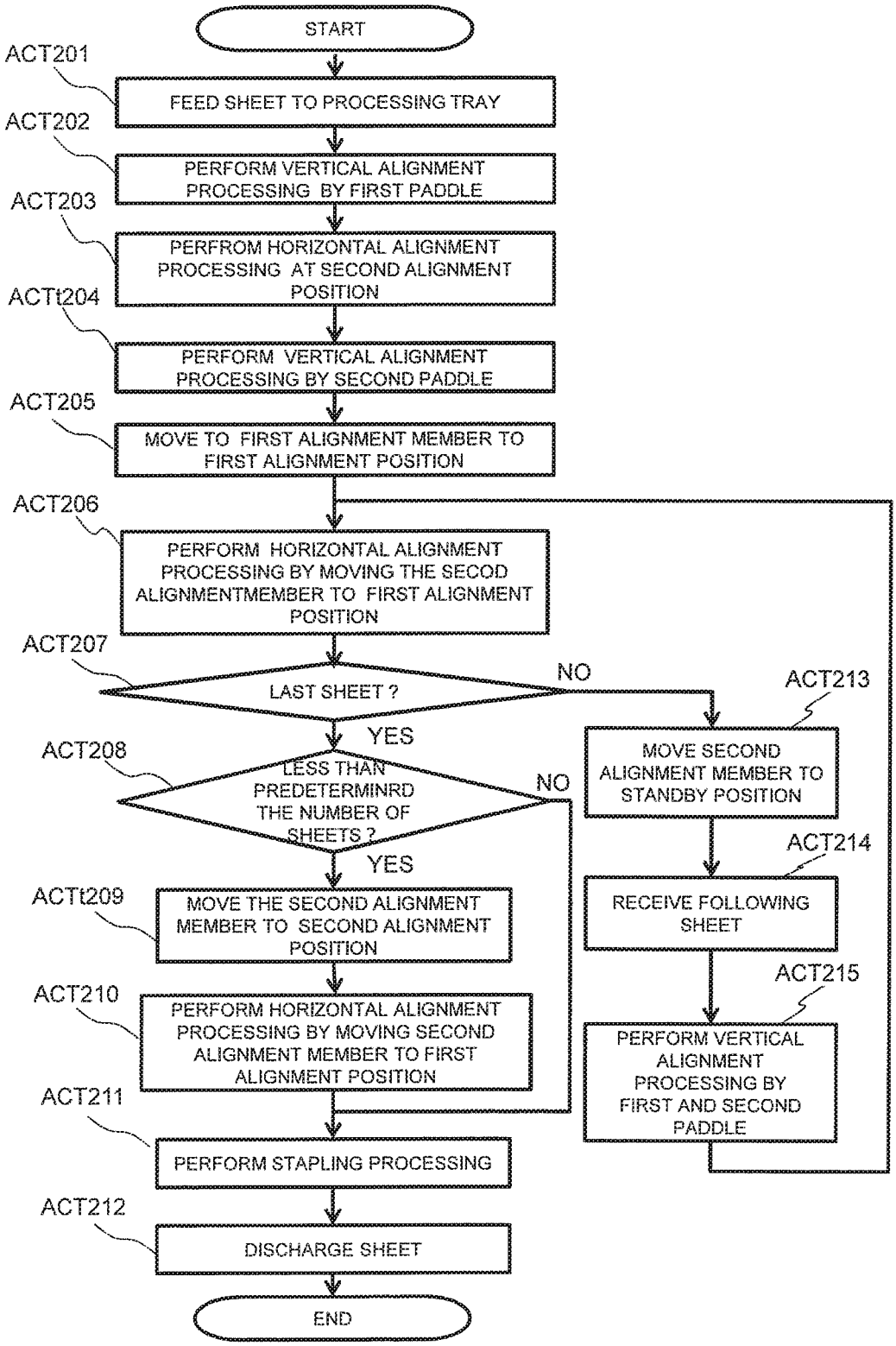
FIG. 23 is a flowchart illustrating the processing performed by the controller according to a second embodiment

FIG. 23 is a flowchart illustrating the processing performed by the controller 24.

Since the processing of ACT 201 to ACT 207 is common to first embodiment, the illustration regarding these processing is omitted. The processing of ACT 208 and subsequent processing is illustrated below.

The controller 24 determines whether a current sheet is the last sheet (ACT 207). The controller 24 determines whether the number of the sheets which is to be processed is greater than the predetermined the number of the sheets (ACT 208), if the controller 24 determines the current sheet is the last sheet (Yes in ACT 207). The reason which is determining whether the number of the sheets which is to be processed is greater than the predetermined the number of the sheets is recited below.

In a case that more the number of the sheets increase, more thickness of the sheets on the processing tray 221 grows in thickness. Accordingly, an area of contact between the paddle section 25 and the sheets increases when the paddle section 25 performs the vertical alignment processing for the sheets on the processing tray 221. Increasing the area of contact encourages the unevenness of the conveyance force by the paddle section 25 at the first alignment position. Thus, if the more the number of the sheets which is to be processed increase, the more the deviation of the sheet at the first alignment position is bigger after the vertical alignment processing at the first alignment position.

If the controller 24 determines the number of the sheets which is to be processed is greater than the predetermined the number of the sheets (Yes in ACT 208), the controller 24 performs the horizontal alignment processing for the plurality of the sheets at first alignment position again by performing the processing of ACT 209 and ACT 210. And then the controller 24 performs the processing of ACT 211 and ACT 212.

On the other hand, the controller 24 determines the number of the sheets which is to be processed is less than the predetermined the number of the sheets (No in ACT 208), the controller 24 performs the processing of ACT 211 and ACT 212 without performing the processing of ACT 209 and ACT 210.

In this way, the sheet post-processing apparatus can change the how to alignment processing at the first alignment position and improve the processing speed by performed by post-processing apparatus, based on the number of sheet to be supposed to process.

Third Embodiment

The processing performed by the controller 24 is illustrated. Specifically, the controller 24 determines whether a printing job sent from the image forming apparatus 1 has information which is indication of the performing the stapling processing. And then the controller 24 changes the number of the horizontal alignment processing for the sheets which performed the vertical alignment processing at the first alignment position.

Figure 24:
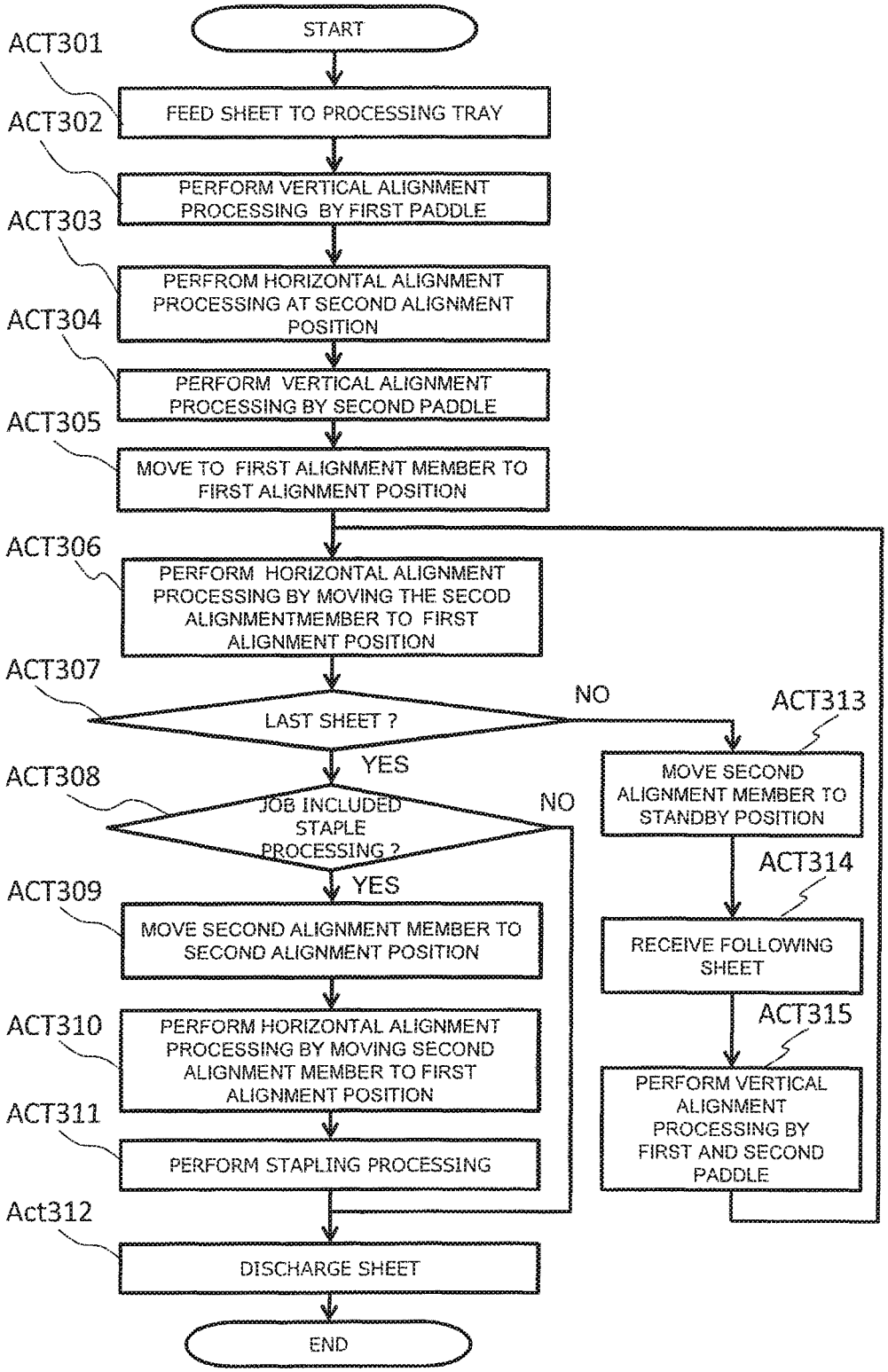
FIG. 24 is a flowchart illustrating the processing performed by the controller according to a third embodiment.

FIG. 24 is a flowchart illustrating the processing performed by the controller 24.

Since the processing of ACT 301 to ACT 307 is common to first embodiment, the illustration regarding these processing is omitted. The processing of ACT 308 and subsequent processing is illustrated below. The controller 24 determines whether a current sheet is the last sheet (ACT 307). If the controller 24 determines the current sheet is the last sheet (ACT 307), the controller 24 determines whether the job has information regarding performing a staple processing, wherein the job is sent from the image information apparatus 1 (ACT 308). The reason why the controller 24 determines whether the job has information regarding performing a staple processing is described as follows. When the sheet post-processing apparatus 2 performs the stapling process, it is necessary to be the state of the sheets aligned is better than when the sheet post-processing apparatus does not performs the stapling processing.

The controller 24 determines the printing job has information regarding performing a staple processing (Yes in ACT 308), the controller 24 performs the horizontal alignment processing for sheets on the processing tray 221 by performing the processing of ACT 309 and ACT 310. Thereafter, the controller 24 performs the processing of ACT 311 and ACT 312 and finishes the series of the processing.

On the other hands, the controller 24 determines the printing job does not have information regarding performing a staple processing (No in ACT 308), the controller 24 controls the discharge section to discharge the sheets to a movable tray 23*b* without performing the processing of ACT 309 to ACT 311. The controller 24 finishes the series of the processing.

In this way, the sheet post-processing apparatus can performs the stapling processing for the sheets aligned desirably at the first alignment portions.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a printer configured to form images on a sheet;

a sheet conveying section configured to convey the sheet output from the printer; a processing tray configured to receive the sheet from the sheet conveying section;

a vertical alignment section configured to align the sheet on the processing tray in a sheet conveying direction by rotation of the vertical alignment section;

a horizontal alignment section configured to align the sheet, in a sheet width direction orthogonal to the sheet conveying direction, between a first alignment member and a second alignment member;

a discharge tray; and a controller configured to control:

the horizontal alignment section to shift the sheet to a first alignment position that is a predetermined distance from the center of the processing tray in the sheet width direction, the horizontal alignment section to align the sheet in the sheet width direction at the first alignment position, the vertical alignment section to align the sheet in the conveying direction at the first alignment position, determine whether a number of sheets on the processing tray is a predetermined number, control the horizontal alignment section to realign the sheet at the first alignment position when the controller determines the number of sheets is the predetermined number, and control the conveying section to discharge the sheet to the discharge tray when the number of sheets on the processing tray is not the predetermined number.

2. The apparatus according to claim 1, wherein the sheet conveying section comprises a conveying roller.

3. The apparatus according to claim 1, wherein the controller is further configured to:

determine whether the sheet conveyed to the processing tray is a last sheet output from the printer in a print job, control the sheet conveying section to convey a next sheet after the sheet to the processing tray when the sheet is not the last sheet, and control the horizontal alignment section to realign the sheet at the first alignment position when the sheet conveyed to the processing tray is not the last sheet.

4. The apparatus according to claim 1, further comprising:

a stapler configured to staple sheets on the processing tray, wherein the controller is further configured to:

determine whether a printing job includes instructions for stapling of sheets associated with the print job, and control the horizontal alignment section to align the sheet at the first alignment position when the printing job includes instructions to staple sheets associated with the printing job.

5. The apparatus according to claim 1, wherein the controller is configured to control the horizontal alignment section to align the sheet in the sheet width direction at a second alignment position, which is different from the first alignment position, before shifting the sheet to the first alignment position.

6. A method for controlling an image formation process of an image forming apparatus, the method comprising:

forming images on a sheet with a printer;

conveying the sheet output from the printer with a sheet conveying section to a processing tray;

receiving the sheet from the sheet conveying section at the processing tray;

aligning the sheet on the processing tray in a sheet conveying direction using rotation of a vertical alignment section;

aligning the sheet on the processing tray, in a sheet width direction orthogonal to the sheet conveying direction, between a first alignment member and a second alignment member using a horizontal alignment section;

shifting the sheet to a first alignment position that is a predetermined distance from the center of the processing tray in the sheet width direction using the first alignment member and the second alignment member;

receiving the sheet discharged from the processing tray at a discharge tray;

determining whether a number of sheets on the processing tray is a predetermined number;

aligning the sheet at the first alignment position using the horizontal alignment section when the number of sheets on the processing tray is the predetermined number; and discharging the sheet to the discharge tray when the number of sheets which on the processing tray is not the predetermined number.

7. The method according to claim 6, wherein the sheet conveying section comprises rollers.

8. The method according to claim 6, further comprising:

determining whether the sheet conveyed to the processing tray is a last sheet in a printing job;

conveying a next sheet after the sheet to the processing tray with the conveying section when the sheet conveyed to the processing tray is not the last sheet in the printing job; and aligning the sheet at the first alignment position when the sheet conveyed to the processing tray is the last sheet in the printing job.

9. The method according to claim 6, further comprising:

receiving a printing job sent including instructions for stapling sheets associated with the printing job; and aligning the sheet at the first alignment position using the horizontal alignment section when the printing job includes instructions to staple sheets associated with the printing job.

10. The method according to claim 6, further comprising:

aligning the sheet in the sheet width direction at a second alignment position different from the first alignment position before shifting the sheet to the first alignment position.

11. An image forming apparatus, comprising:

a printer configured to form images on a sheet;

a sheet conveying section configured to convey the sheet output from the printer a processing tray configured to receive the sheet from the sheet conveying section;

a vertical alignment section configured to align the sheet on the processing tray in a sheet conveying direction by rotation of the vertical alignment section;

a horizontal alignment section configured to align the sheet, in a sheet width direction orthogonal to the sheet conveying direction, between a first alignment member and a second alignment member; and a controller configured to control:

the horizontal alignment section to shift the sheet to a first alignment position that is a predetermined distance from the center of the processing tray in the sheet width direction, the horizontal alignment section to align the sheet in the sheet width direction at the first alignment position, and the vertical alignment section to align the sheet in the conveying direction at the first alignment position, wherein the controller is further configured to control the horizontal alignment section to align the sheet in the sheet width direction at a second alignment position, which is different from the first alignment position, before shifting the sheet to the first alignment position.

* * * * *